US009675216B2

(12) United States Patent
Brokopp, Jr. et al.

(10) Patent No.: US 9,675,216 B2
(45) Date of Patent: Jun. 13, 2017

(54) CONVOLUTELY WOUND MATERIAL

(71) Applicant: The Procter & Gamble Company, Cincinnati, OH (US)

(72) Inventors: Wesley Bernard Brokopp, Jr., Middletown, OH (US); James Max Smith, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/685,636

(22) Filed: Apr. 14, 2015

(65) Prior Publication Data

US 2016/0302625 A1 Oct. 20, 2016

(51) Int. Cl.

| | |
|---|---|
| ***B65H 18/08*** | (2006.01) |
| ***A47K 10/16*** | (2006.01) |
| ***D21H 27/02*** | (2006.01) |
| ***B65H 18/28*** | (2006.01) |

(52) U.S. Cl.
CPC ..... *A47K 10/16* (2013.01); *B65H 18/28* (2013.01); *D21H 27/02* (2013.01)

(58) Field of Classification Search
CPC ..... B65H 18/08; B65H 18/28; B65H 18/00
USPC ..... 162/231
See application file for complete search history.

(56) References Cited

U.S. PATENT DOCUMENTS 3,994,396 A * 11/1976 Reilly ..... C09J 103/02 156/187
5,143,776 A * 9/1992 Givens ..... B32B 7/14 428/194
5,194,299 A * 3/1993 Fry ..... C09J 7/0207 427/208.6
5,259,910 A 11/1993 Biagiotti
5,474,646 A 12/1995 Matteucci
5,573,615 A 11/1996 Vigneau et al.
RE35,729 E 2/1998 Biagiotti
5,800,652 A 9/1998 Vigneau et al.
5,843,057 A * 12/1998 McCormack ..... A41D 31/02 128/849
6,143,111 A 11/2000 Biagiotti
7,799,402 B2 * 9/2010 Redmann ..... A47K 10/16 156/184
7,846,286 B2 12/2010 Gelli
2002/0170649 A1 * 11/2002 Butterworth ..... B65H 19/29 156/64
2003/0118767 A1 6/2003 Krzysik et al.
2005/0058752 A1 * 3/2005 Deason ..... B65H 18/28 426/327
2005/0199759 A1 * 9/2005 Redmann ..... A47K 10/16 242/160.4
2007/0298224 A1 * 12/2007 Byrne ..... B65H 19/29 428/192
2011/0147491 A1 6/2011 Pope et al.
2014/0131498 A1 * 5/2014 Brokopp, Jr. ..... B65H 19/29 242/160.4
2015/0375951 A1 * 12/2015 Mellin ..... B65H 19/29 428/484.1

OTHER PUBLICATIONS

All Office Actions, U.S. Appl. No. 14/319,510, filed Jun. 30, 2014 (P&G Case 13449).

* cited by examiner

*Primary Examiner* — Mark Halpern
(74) *Attorney, Agent, or Firm* — Roddy M. Bullock

(57) ABSTRACT

A convolutely wound material having a tail and a body. The tail is bonded to the body with foamed adhesive.

7 Claims, 12 Drawing Sheets

CONVOLUTELY WOUND MATERIAL

CROSS REFERENCE TO RELATED APPLICATIONS

This Application is a Divisional of application Ser. No. 13/800,019, filed Mar. 13, 2013; which claimed the benefits of Provisional Application Ser. No. 61/725,155, filed Nov. 12, 2015.

FIELD OF THE INVENTION

The present disclosure provides for an apparatus and method for gluing the tail or other end of a convolutely wound log of web material thereto in order to form a roll suitable for consumer use.

BACKGROUND OF THE INVENTION

In the manufacture of rolled web products, such as bath tissue or paper towels, a winder winds a web of material to form a large parent roll. The parent roll is then subsequently unwound, subjected to a variety of conversions, such as embossing, and then rewound by a rewinder into a consumer diameter sized convolutely wound log. The convolutely wound log is eventually cut into consumer width sized rolls, such as bath tissue, paper towels and similar finished products. To efficiently process the convolutely wound log through converting processes, cutting and packaging, the loose end of the log (i.e., the tail) is often secured or sealed to the body (i.e., the non-tail portion).

Common gluing, moistening and other systems known to those in the tail gluing art typically require some manipulation of the tail for correct alignment in adhesive application, proper winding or rewinding and the like. In most commercially available embodiments, the tail is laid flat and unwrinkled against the log with the tail being secured to the log at a position a short distance from the very end of the tail. This tail sealing arrangement leaves a small length of the end of the tail unsecured (the so-called "tab") to enable the end user to grasp, unseal and unwind the convolutely wound product.

Known methods and systems for tail sealing face many undesirable results. For example, many systems dispense excess adhesive that is not picked up by the convolutely wound roll. Such excess adhesive is often recovered in an underlying tank and made to flow back into the system. Other known systems incorporate a bath or pool of adhesive which is provided in an open condition. In both situations, the systems allow dust, debris and other foreign matter to be incorporated into the adhesive, thus polluting the adhesive flow stream and/or reducing the effectiveness of the adhesive upon subsequent rolls. Such systems typically incorporate filtration systems in an effort to remove such pollutants from the adhesive stream. Such filtration systems add increased cost to the systems as well as provide routine maintenance issues.

Many known systems also have been found deficient when attempting to obtain a sufficient amount of adhesion. Adhesion problems may arise due to substrate specifications and enhancements, such as high topography or strength-inducing chemicals. Modern papermaking and embossing techniques have been able to provide web substrates that have a high degree of deflection in the direction orthogonal to the plane formed by the web substrate. Many known systems can utilize only the portions of the substrate having a high degree of deflection as a suitable bonding area because the portions of the substrate having a low degree of deflection are unavailable or less available to serve as contact points between surfaces sought to be connected. This limited bonding area has resulted in insufficient adhesion because of limited opportunities for adhesive contact. Strength-inducing chemistries utilized in producing paper web substrates also contribute to adhesion issues. Manufacturers are increasingly incorporating strength-inducing chemicals to substrates to enhance quality. Yet, such chemicals may interfere with the bonding of adhesives in tail sealing.

Further, adhesion issues have arisen from the type of adhesive and method of application. Indeed, known systems often emit adhesives in such a manner that the adhesives penetrate below the surface of the paper web substrate as opposed to residing on the surface. Adhesive absorbed below the surface results in less adhesive being available for bonding at the surface and therefore less adhesion.

Moreover, known tail gluing systems often utilize adhesive that dries slower than desired. It is desirable that tail seal adhesive dry quickly, so that the bond is set in time for downstream converting operations (e.g., wrapping, bundling, etc.). A log typically is processed through such processes in about 5-10 minutes. Yet, known systems utilize adhesives with drying times of more than an hour—which fully dry long after the product is cycled through the manufacturing processes. In such cases, manufacturers often rely on temporary bonding primarily attributable to cohesive bonding within the adhesive, which is typically substantially lower than the final strength of the adhesive when it is fully dried (i.e., after sufficient time has passed to achieve maximum bonding).

Insufficient drying and/or bonding also can occur based on heavy localized application of the adhesive, where the adhesive is concentrated in particular areas due to the application design. The formulation of the adhesive may contribute to adhesion problems as well, with many typical formulations containing about 85% to 97% water. Water not only inhibits drying but also interferes with bonding.

The lack of sufficient adhesion produces manufacturing problems such as tearing, wrinkled tails, unsightly bonding areas and/or delays in production due to loose tails. To compensate for deficient bonding, manufacturers have over-applied adhesive to the tail to create some sense of quick adhesion, which is mostly due to the internal cohesive strength of the glue itself. Yet, this can result in negative end user feedback because, once the adhesive completely dries, the tail becomes difficult to remove from the roll and can cause the separation of plies and/or tearing of sheets.

In addition, tail sealing processes struggle with precise placement of adhesive to create the tab of the tail and ensure the roll does not become unsightly due to the tail sealed portion.

Thus, it would be advantageous to provide for a tail gluing system that addresses one or more of these issues. Indeed, it would be advantageous to minimize or even eliminate the prospect of contamination of the adhesive. It would also be useful to provide for a tail gluing system that increases adhesive efficiency, such that it provides sufficient bonding for substrates having high surface topography (despite the limited available bonding area) and/or substrates with strength-inducing chemistries. Likewise, it would be beneficial to provide for a system that reduces both the amount of adhesive required and the drying time necessary to provide suitable bonding. Additionally, it would be beneficial to provide a tail sealing system that reduces negative end user feedback and/or allows for adhesive to be applied in a pattern. Finally, it would be advantageous to provide for a tailing sealing system that increases throughput, reduces the components required to operate effectively and provides for a mechanism that reduces the maintenance required upon such a tail gluing system.

SUMMARY OF THE INVENTION

The present invention fulfills the needs described above by providing an apparatus for adhesively bonding the tail of a convolutely wound log of web material to the body of the log, where the apparatus comprises a tail identifying system for identifying the presence and position of the tail, a spray nozzle adhesive application system positioned downstream from the tail identifying system to receive the log from the tail identifying system and a tail winding system positioned downstream from the spray nozzle adhesive application system to receive the log from the spray nozzle adhesive application system. The spray nozzle adhesive application system may comprise a plurality of nozzles, each nozzle having a discharge portion configured to spray a foaming adhesive in a predetermined deposit pattern at a respective spray site on either the tail or the body. The predetermined deposit patterns may combine to form a line of adhesive on the tail or the body. The tail winding system may be capable of joining the tail to the body at the line of adhesive.

In another embodiment, a method for adhesively bonding a tail of a convolutely wound log of web material to the body of the log is provided. The method may comprise the steps of: providing a sealing station with a tail identifying system for identifying the presence and position of the tail; providing the sealing station with a spray nozzle adhesive application system comprising a plurality of nozzles, each nozzle being capable of spraying a foaming adhesive in a predetermined deposit pattern at a respective spray site on the tail or the body. The method may further comprise the step of spraying the foaming adhesive, each nozzle spraying the foaming adhesive in a predetermined deposit pattern at a respective spray site on the tail or the body to form a line of adhesive on the tail or the body. Further, the method may include the step of reattaching the tail to the body at the line of adhesive.

In yet another embodiment, a convolutely wound material having a tail and a body, where the tail is bonded to the body with a foaming adhesive, is provided.

DETAILED DESCRIPTION

Figure 1:
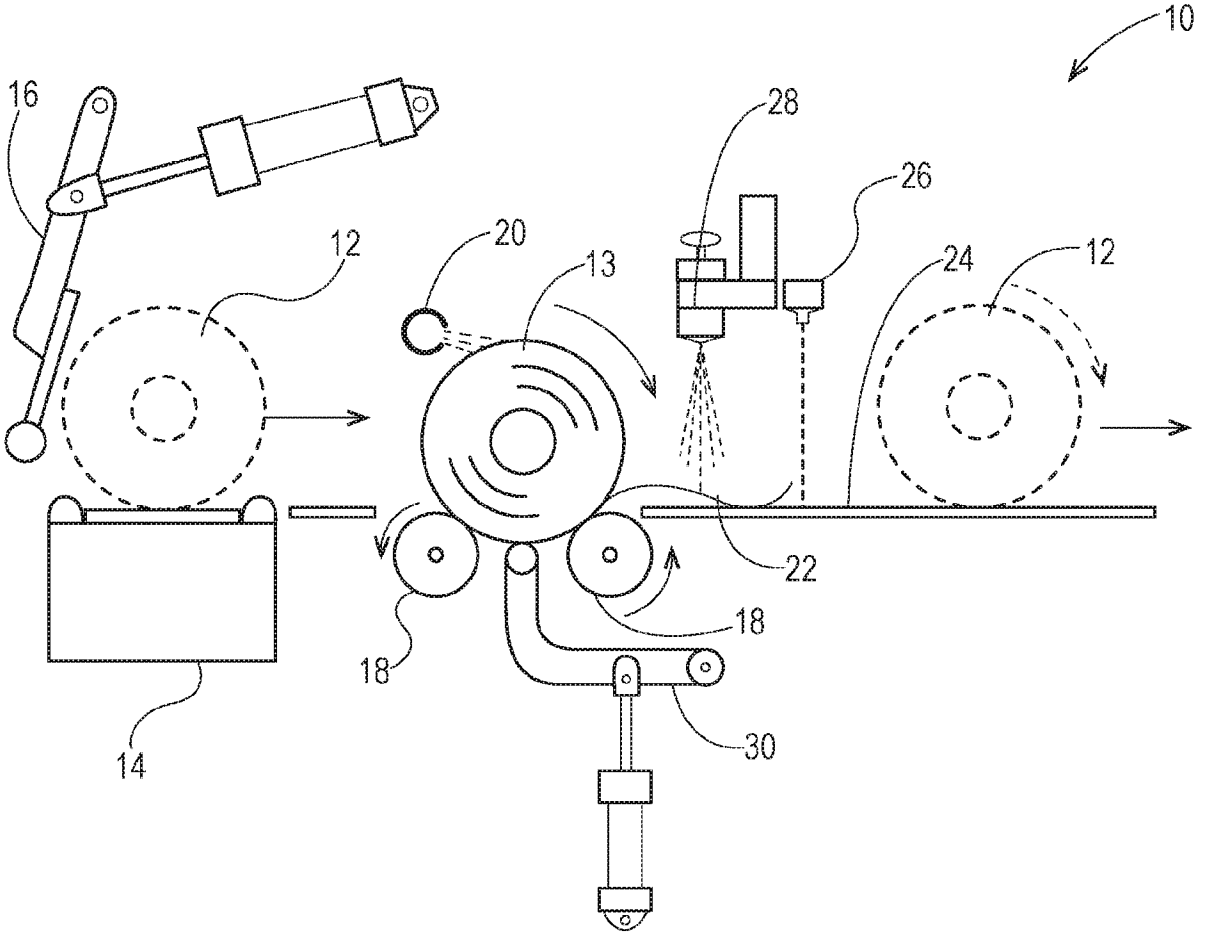
Fig. 1 PRIOR ART
FIG. 1 is a cross-sectional view of an exemplary typical tail sealing apparatus.

The present disclosure provides for equipment, methods and products using foaming adhesive for tail sealing a convolutely wound log of material. Various nonlimiting embodiments of the present disclosure will now be described to provide an overall understanding of the principles of the function, design and use of the tail sealing apparatuses and methods as well as the tail sealed convolutely wound products disclosed herein. One or more examples of these nonlimiting embodiments are illustrated in the accompanying drawings. Those of ordinary skill in the art will understand that the apparatuses, methods and products described herein and illustrated in the accompanying drawings are nonlimiting example embodiments and that the scope of the various nonlimiting embodiments of the present disclosure are defined solely by the claims. The features illustrated or described in connection with one nonlimiting embodiment can be combined with the features of other nonlimiting embodiments. Such modifications and variations are intended to be included within the scope of the present disclosure.

DEFINITIONS

"Fibrous structure" as used herein means a structure that comprises one or more filaments and/or fibers.

Nonlimiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking and may subsequently be converted into a finished product (e.g., a sanitary tissue product such as a paper towel product).

The fibrous structures of the present invention may be homogeneous or may be layered. If layered, the fibrous structures may comprise at least two and/or at least three and/or at least four and/or at least five layers.

The fibrous structures of the present invention may be co-formed fibrous structures.

"Fiber" and/or "Filament" as used herein means an elongate particulate having an apparent length greatly exceeding its apparent width (i.e., a length to diameter ratio of at least about 10). In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Nonlimiting examples of fibers include wood pulp fibers and synthetic staple fibers such as polyester fibers.

Filaments are typically considered continuous or substantially continuous in nature. Filaments are relatively longer than fibers. Nonlimiting examples of filaments include meltblown and/or spunbond filaments. Nonlimiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. Also applicable to the present invention are fibers derived from recycled paper, which may contain any or all of the above categories as well as other non-fibrous materials such as fillers and adhesives used to facilitate the original papermaking.

"Sanitary tissue product" as used herein means a soft, low density (i.e., <about 0.15 g/cm$^3$) web useful as a wiping implement for post-urinary and post-bowel movement cleaning (toilet tissue), for otorhinolaryngological discharges (facial tissue) and multi-functional absorbent and cleaning uses (absorbent towels). The sanitary tissue product may be convolutely wound upon itself about a core or without a core to form a sanitary tissue product roll.

The sanitary tissue products and/or fibrous structures of the present invention may exhibit a basis weight of greater than 15 g/m$^2$ (9.2 lbs/3000 ft$^2$) to about 120 g/m$^2$ (73.8 lbs/3000 ft$^2$) and/or from about 15 g/m$^2$ (9.2 lbs/3000 ft$^2$) to about 110 g/m$^2$ (67.7 lbs/3000 ft$^2$) and/or from about 20 g/m$^2$ (12.3 lbs/3000 ft$^2$) to about 100 g/m$^2$ (61.5 lbs/3000 ft$^2$) and/or from about 30 (18.5 lbs/3000 ft$^2$) to 90 g/m$^2$ (55.4 lbs/3000 ft$^2$). In addition, the sanitary tissue products and/or fibrous structures of the present invention may exhibit a basis weight between about 40 g/m$^2$ (24.6 lbs/3000 ft$^2$) to about 120 g/m$^2$ (73.8 lbs/3000 ft$^2$) and/or from about 50 g/m$^2$ (30.8 lbs/3000 ft$^2$) to about 110 g/m$^2$ (67.7 lbs/3000 ft$^2$) and/or from about 55 g/m$^2$ (33.8 lbs/3000 ft$^2$) to about 105 g/m$^2$ (64.6 lbs/3000 ft$^2$) and/or from about 60 (36.9 lbs/3000 ft$^2$) to 100 g/m$^2$ (61.5 lbs/3000 ft$^2$).

The sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in).

In another example, the sanitary tissue products of the present invention may exhibit a total dry tensile strength of greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present invention may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present invention may exhibit an initial total wet tensile strength of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 On) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The sanitary tissue products of the present invention may exhibit a density (measured at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may comprise additives such as softening agents, such as quaternary ammonium softening agents, temporary wet strength agents, permanent wet strength agents, bulk softening agents, lotions, silicones, wetting agents, latexes, dry strength agents, and other types of additives suitable for inclusion in and/or on sanitary tissue products.

The embodiments discussed herein may be utilized with a convolutely wound log of web material, such as a convolutely wound log of a fibrous structure. The fibrous structure may comprise a sanitary tissue product.

"Consumer-sized product unit" as used in herein means the width of a finished product of convolutely wound web material, as measured in the cross machine direction, as such product will be sold, distributed or otherwise provided to end users.

"Spray site" as used herein means the desired location at which adhesive emitted from a given nozzle in accordance the present disclosure is to be deposited on the web material. The spray site may be located on the tail, the body (i.e., the non-tail portion of the log) or the crevice where the tail and the body meet.

"Machine direction" or "MD" as used herein means the direction parallel to the flow of the web material through the manufacturing equipment.

"Cross machine direction" or "CD" as used herein means the direction parallel to the width of the manufacturing equipment and perpendicular to the machine direction.

The Z-direction is orthogonal both the machine direction and cross machine direction, such that the machine direction, cross machine direction and Z-direction form a Cartesian coordinate system.

"Line of adhesive" as used herein means a macroscopically linear shape that may be essentially continuous (or unbroken) or semi-continuous (wherein the line of adhesive is intermittent, such as a dotted line). In one embodiment of the present invention, the line of adhesive extends in the cross machine direction. As used herein, a shape is "macroscopically linear" if, when viewed with the unaided human eye at a distance of about 12 inches, such shape appears to form a substantially straight line (continuous or semi-continuous) or a substantially repeating pattern (continuous or semi-continuous).

"Above", "over", "top", "up", "below", "beneath", "bottom" and "under" and similar orientational words and phrases, except upstream and downstream, as used herein to describe embodiments are to be construed relative to the normal orientation, where the floor is located in the Z-direction below, beneath or under a tail sealing apparatus and the ceiling is located in the Z-direction above or over a tail sealing apparatus. Articles expressed as being above, over, on top and the like are located (or moving) in the Z-direction closer to the ceiling than the items to which they are being compared. Similarly, articles expressed as being below, beneath or under and the like are located (or moving) in the Z-direction closer to the floor than their respective comparators. One of skill in the art will recognize that the relationship between the article and its respective comparator is more significant than the relationship between the article and the floor or the ceiling. As such, inverted arrangements of articles as disclosed herein are included within the scope of this disclosure. Said differently, to the extent such configurations are workable, this disclosure is intended to include an apparatus and/or method where everything expressed as "below" is inverted to be "above" and everything expressed as "above" is inverted to be "below" and similar reversals or inversions.

"Downstream" as used herein means a step or system occurring or present later in a processing continuum. "Upstream" as used herein means a step or system occurring or present earlier in a processing continuum.

Typical Tail Sealers

A short description of typical tail sealers follows to provide context for the present invention.

A. Typical Spray Application Style

As shown in FIG. 1, an exemplary prior art tail sealer is a "conventional spray system" style 10. In a conventional spray system 10, the tail sealer apparatus is mounted directly downstream of a rewinder and is an integral part of a converting operation. Generally, the apparatus 10 is provided with a: 1. Log in-feed; 2. Log index to sealing station; 3. Tail detection and positioning; 4. Spray application of adhesive; 5. Tail rewinding; and 6. Log discharge. An exemplary conventional spray system sealer 10 is the T30Spray® tail sealing apparatus, commercially available from Paper Converting Machine Co.

As shown in FIG. 1, in an exemplary conventional spray system 10, the log 12 enters through the in-feed conveyer 14. An in-feed kicker 16 then indexes the log 12 into a plurality of rotating turn rollers 18. The log 12 settles between turn rollers 18, and the turn rollers 18 rotate the log 12 in place. A blow pipe 20 emits a burst of air, causing the tail 22 to separate from the body 13 of the log 12 and move towards a table 24. As the turn rollers 18 continue to rotate the log 12, the tail 22 moves within range of the tail detection mechanism 26 (e.g., a photo eye sensor) and rests on or near the table 24. Once the tail 22 is detected, a plurality of glue guns 28 simultaneously emit liquid adhesive at an application pressure of about 2,000 psi and a viscosity of about 15,000 cps to about 23,000 cps.

The number of glue guns 28 may correspond to the number of finished consumer-sized product units anticipated to be cut from the log 12. For example, there may be nine glue guns 28 for a log 12 expected to produce nine finished consumer-sized product units (i.e., one glue gun per position of the anticipated finished product). Adhesive may cause build up on saws that are used to cut the log 12 into consumer-sized product units. It is believed that less liquid adhesive will be found on the areas that will be cut by the saws if only one glue gun is positioned to cover one anticipated consumer-sized product unit. This reduces the amount of overlapping deposits of adhesive at the cutting areas. Consequently, the amount of adhesive the saw may encounter during cutting the log 12 into consumer-sized product units is reduced as is the likelihood for build up.

The glue guns 28 are arranged such that they extend through the width of the log 12 in the cross machine direction and may be positioned above the table 24 at an angle of about 90 degrees relative to the table 24, or any other angle suitable to emit the glue at the desired location. After the glue is applied, the turn rollers 18 continue to roll, causing the tail 22 to rewind and reconnect to the body 13 as the weight of the log 12 presses the tail 22 and body 13 together. After the tail 22 is reconnected to the log 12, an auxiliary kicker 30 ejects the log 12 toward the next converting operation—typically an accumulator in-feed. Conventional spray system tail sealers 10 may operate at a rate of up to about 22 logs processed/minute. Such systems 10 may include timers and/or other control features to manage the rate of operation and/or prevent backlog or overfeeding of the logs 12 into the tail sealer 10.

B. Typical Blade-in-Pan or Plate Style Apparatus

Figure 3:
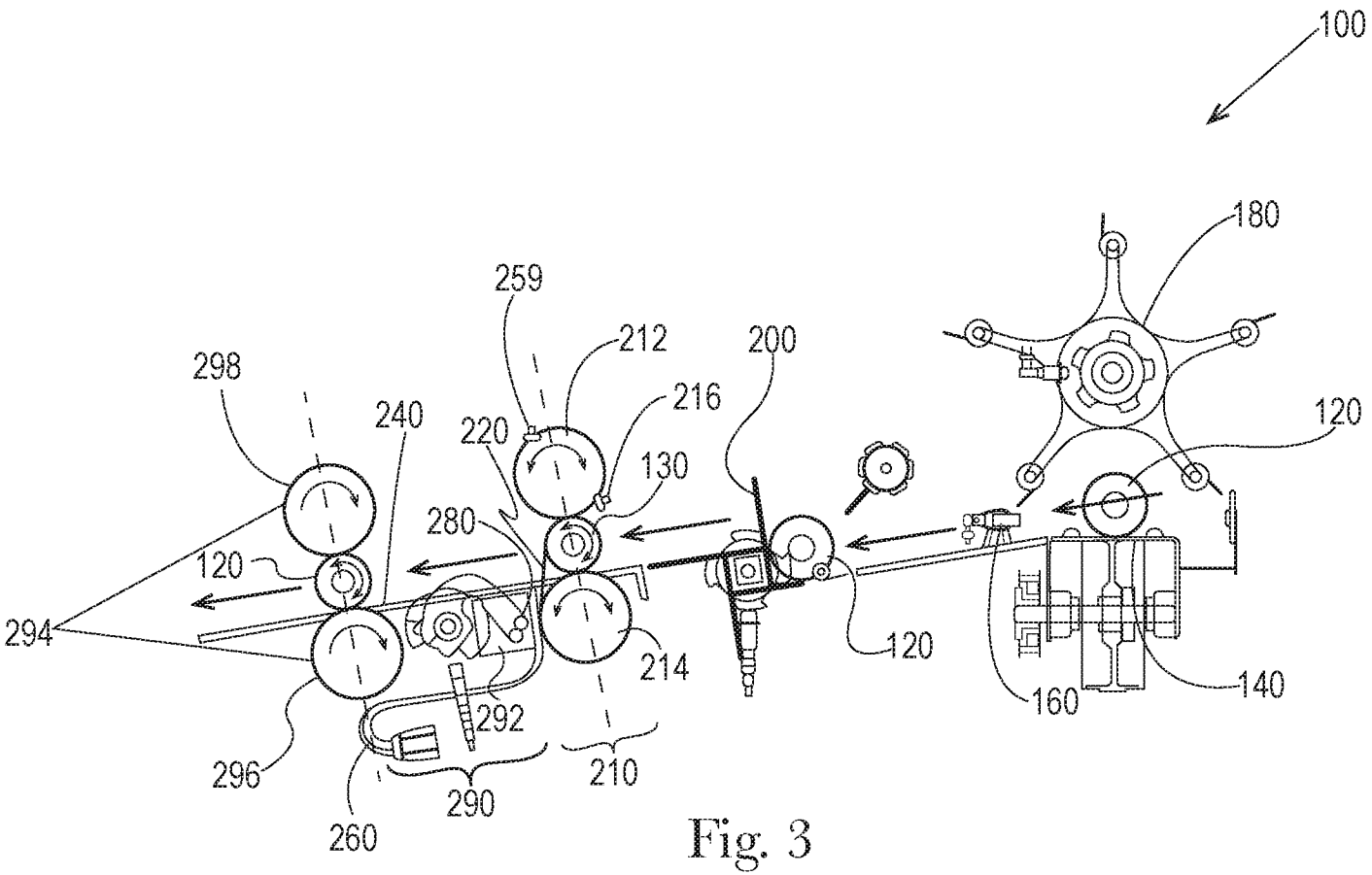
FIG. 3 is a cross-sectional view of an exemplary typical tail sealing apparatus.

As shown in FIG. 3, an exemplary prior art tail sealer is a "blade-in-pan" or "plate" style tail sealer 100 that provides an in-line style tail sealer. As with the conventional spray system style 10, the tail sealer apparatus in the blade-in-pan style 100 is also mounted directly downstream of a rewinder and is an integral part of a converting operation. Likewise, the apparatus 100 has many of the same basic steps of the conventional spray system 10, except a blade, bar or wire operation exists in lieu of the spray application step. In other words, the apparatus 100 for applying an adhesive to a convolutely wound log of web material is provided with a: 1. Log in-feed; 2. Log index to sealing station; 3. Tail detection and positioning; 4. A "blade-in-pan" or "plate style" adhesive application; 5. Tail rewinding; and 6. Log discharge. An exemplary blade-in-pan or plate style tail sealer 100 is the ROTOSEAL® tail sealing apparatus, commercially available from Paper Converting Machine Co. Other examples of a typical plate style tail sealer include the 560C® and 561 DLX® tail sealing apparatus models, both commercially available from Fabio Perini S.p.A.

As shown in FIG. 3, the log 120 enters at the in-feed conveyor 140. An incoming log detector 160 (e.g., a photo eye sensor) detects when the log 120 is in position on the in-feed conveyor 140 and activates a rotary kicker 180 that pushes the log 120 off the conveyor 140 toward the index paddle 200. The index paddle 200 receives the log 120 and holds it until the in-feed rolls 210 are clear. The index paddle 200 then indexes about 90 degrees, moving the log 120 into the in-feed rolls 210. In-feed rolls 210 will typically comprise an upper in-feed roll 212 and a lower in-feed roll 214 (typically a vacuum roll).

The in-feed rolls 210 initially rotate in the same direction but at mismatched speeds, with the upper in-feed roll 212 rotating faster than the lower in-feed (or vacuum) roll 214. The distance of upper in-feed roll 212 relative to lower in-feed roll 214 can be adjusted to accommodate the log 120 diameter. However, the upper in-feed roll 212 is typically positioned to create some interference with the log 120. When the log 120 is fed into the in-feed rolls 210, the log 120 may be controlled at the top and bottom log 120 positions because of the interference and rate of log 120 travel is controlled by the speed difference between the in-feed rolls 210. If there is too little or no interference, the log 120 could slide through the in-feed rolls 210. Conversely, if there is too much interference, the logs 120 may not feed into the in-feed rolls 210 correctly and could cause a jam up at the index paddle 200.

As the log 120 contacts the in-feed rolls 210, it is pulled into the nip between the in-feed rolls 210 by the differential speed. As the log 120 reaches the diagonal center of the in-feed rolls 210, it blocks the log in-feed rollers detector 216 (e.g., photo eye sensor) at which time the in-feed rolls 210 rotate at a matched speed. This holds the log 120 in position while an airblast nozzle 259 emits a stream of air to separate the tail 220 from the log 120 and position the tail 220 flat onto the table 240 where a tail detector 260 (e.g., a PEC) becomes blocked by the tail 220. As the log 120 rotates and rewinds the separated tail 220, the tail detector 260 becomes unblocked when the edge of the tail 220 has been located.

After the edge of the tail 220 is detected, the tail 220 is rewound onto the log 120 until the edge of the tail 220 is directly underneath the body 130 of the log 120. The in-feed rolls 210 stop and reverse direction, which unrolls the tail 220 from the body 130. The tail 220 is held by vacuum to the lower in-feed roll 214 and follows the lower in-feed roll 214 as it is unwound until a calculated length of tail 220 has been separated from the body 130. The in-feed rolls 210 then stop and the upper in-feed roll 212 starts rotating back in the forward direction to eject the body 120 from the in-feed rolls 210. The tail length centerline controls the amount of tail 220 that is unwound from the log 120 and is typically adjusted to get the target tab length. The speed of in-feed rolls 210 can impact consistent tail detection. Higher speeds can reduce the time to rotate the log 120 but may not increase rate capability. The speed of in-feed rolls 210 can be adjusted to consistently detect the tail 220 on the first revolution.

While the tail 220 is being detected, the glue blade (or bar or wire) 280 of the blade-in-pan assembly (or bar or wire and pan assembly) 290 is submerged in the glue pan 292. After the tail of log 220 is detected, the glue blade 280 is raised out of the glue pan 292 and is timed so that the body 130 rolls over glue blade 280 after being ejected from the in-feed rolls 210. After the log 120 passes, the glue blade 280 is lowered back into the glue pan 292. The glue blade 280 height can be adjusted so that the top of the glue blade 280 is slightly higher than the adjacent table 240.

After glue application, the log 120 rolls down the table 240 to the out-feed rolls 294 which compress the tail 220 to the body 130. The lower out-feed roll 296 runs slower than the upper out-feed roll 298, which moves the log 120 through the out-feed rolls 294 for a controlled duration, similar to the in-feed rolls 210. The lower out-feed roll 296 speed is controlled as a percentage of the upper out-feed roll 298 speed. More closely matching the upper out-feed roll 298 and lower out-feed roll 296 speeds will allow the out-feed rolls 294 to hold the log 120 longer.

When the log 120 is released from the out-feed rolls 294, it rolls down the table 240 to the next converting operation—typically an accumulator in-feed. A typical blade-in-pan style tail sealer 100 may operate at a rate of not less than about 20 logs processed/minute, or at rate of about 30 to about 60 logs processed/minute, or a rate of about 50 to about 60 logs processed/minute.

Spray Application of Foamed Adhesive

In one embodiment of the present invention, the tail sealer apparatus 10*a*, 100*a* may involve some of the same components as the description above in combination with a tail identifying system for identifying the presence and position of the tail, a spray nozzle application system 400 that is capable of spraying a foaming adhesive 406 in a predetermined pattern to form a line of adhesive 402 and a tail winding system capable joining the tail 12*a*, 120*a* to the body 13*a*, 130*a* at the line of adhesive 402. In one embodiment, the tail sealer 10*a*, 100*a* may include a tail positioning component that is capable of circumferentially displacing the tail 22*a*, 220*a* from the body 13*a*, 130*a*. The tail positioning component may be part of the tail identifying system.

Figure 2:
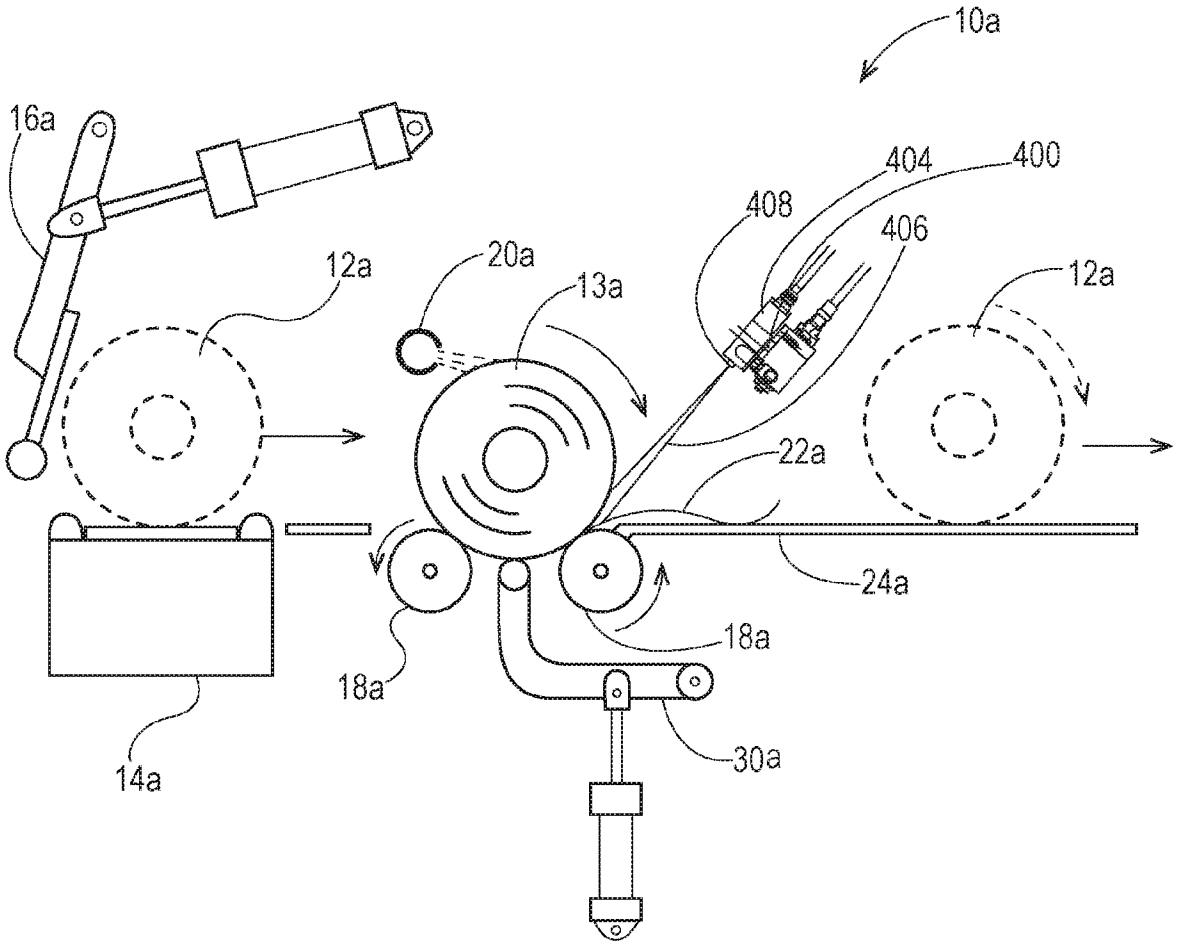
FIG. 2 is cross-sectional view of an exemplary tail sealing apparatus in accordance with on embodiment of the present disclosure.

In one nonlimiting example, as shown in FIG. 2, a tail sealing apparatus 10*a* has an in-feed conveyer 14*a* where the log 12*a* enters the tail seal apparatus 10*a*. An in-feed kicker 16*a* may then index the log 12*a* into a plurality of rotating turn rollers 18*a*. The log 12*a* may then settle between turn rollers 18*a*, and the turn rollers 18*a* may rotate the log 12*a* in place. A blow pipe 20*a* can emit a burst of air, causing the tail 22*a* to separate from the log 12*a* and move towards a table 24*a*. The turn rollers 18*a* can continue to rotate the log 12*a*, such that the tail 22*a* moves within range of the tail detection mechanism 26*a* (e.g., a photo eye sensor) and rests on or near the table 24*a* generally beneath the spray nozzle application system 400.

In an alternative embodiment, the tail sealer 10*a* may identify the tail 22*a* by using a counting mechanism. In one nonlimiting example, the tail sealer 10*a* is capable of anticipating the tail 22*a* by counting the number of sheets processed through the system. The apparatus 10*a* may count the number of sheets required to produce the desired log 12*a* and identify the tail 22*a* as the last sheet in the count.

Once the tail 22*a* is detected, the spray nozzle application system 400 may emit a line of adhesive 402. The log 12*a* may be held stationary while the line of adhesive 402 is being emitted or the log 12*a* may be moving.

In one embodiment, the spray nozzle application system 400 includes a nozzle 404 that is capable of dispensing a foaming adhesive 406 and that has a discharge portion 408. The discharge portion 408 may be configured to spray the foaming adhesive 406 in a predetermined deposit pattern. Such predetermined deposit pattern may form part of the line of adhesive 402. In one nonlimiting example, the discharge portion 408 is configured to spray the foaming adhesive 406 such that it will deposit on a spray site in a generally two-dimensional circular pattern. In another nonlimiting example, the deposit pattern may be generally two-dimensionally ovular. In yet another nonlimiting example, the discharge portion 408 is configured such that the deposit pattern has a two-dimensional shape, such as an oval, egg shape or ellipse, having an aspect ratio of about 1.1 or more, or about 2 or more. For purposes of this disclosure, the aspect ratio of a shape is measured in the MD-CD plane and is the ratio of the length of the longest dimension or diameter of the shape, in any direction, that intersects the shape's midpoint and length of the shortest dimension or diameter of the shape, in any direction, that intersects the shape's midpoint.

The configuration of the discharge portion 408 may be a function of the several factors, including but not limited to spray pressure and velocity, the distance between the discharge portion 408 and the spray site and/or table 24*a*, the angle of the discharge portion 408 relative to the spray site and/or table 24*a*, the desired density of the adhesive applied or the desired deposit pattern.

In one embodiment, the nozzle 404 is positioned at an angle of about 45 degrees to about 135 degrees relative to the spray site. In another embodiment, the nozzle 404 is positioned at an angle of about 45 degrees to about 135 degrees relative to the table 24*a*. In a further embodiment, the nozzle 404 is positioned from about 4 to about 16 inches from the spray site, or from about 6 inches to about 12 inches from the spray site, or from about 6 inches to about 8 inches from the spray site. In yet another embodiment, the nozzle is positioned from about 4 to about 16 inches from the table 24*a*, or from about 6 to about 12 inches from the table 24*a*, or from about 6 inches to about 8 inches from the table 24*a*.

For purposes of this disclosure, angles and/or distances from the spray site are measured as follows: Where the spray site is found on the tail 22*a*, 220*a*, the distance and/or the angle of the nozzle 404 in relation to the spray site is measured from the outermost edge 410 of the discharge portion 408 to the plane of a section of the spray site that is macroscopically monoplanar. As used herein a section is "macroscopically monoplanar" if such section appears to be contained within one plane when viewed with the unaided human eye at a distance of about 12 inches.

Where the spray site is found on the body 13*a*, 130*a*, the distance and/or the angle of the nozzle 404 in relation to the spray site is measured from the outmost edge 410 of the discharge portion 408 to a plane created by a tangent line running through the circumference of the body 13*a*, 130*a* at the point most proximate to the outmost edge 410 of the discharge portion 408.

Where the spray site is found in the crevice where between the tail 22*a*, 220*a* and the body 13*a*, 130*a*, the distance and/or angle of the nozzle 404 in relation to the spray site is measured from the outmost edge 410 of the discharge portion 408 to a point within of the spray site where the tail 22*a*, 220*a* and the body 13*a*, 130*a* meet.

In yet another embodiment, the spray nozzle application system 400 comprises a plurality of nozzles 404 of the present disclosure that are mounted or otherwise connected to the tail sealing apparatus 10*a* such that they are substantially spaced apart in a generally linear manner in the cross machine direction. In another embodiment, the nozzles 404 may be positioned in a pattern such that they do not form a straight line in the cross machine direction. In one embodiment, the plurality of nozzles 404 includes from about 9 to about 12 nozzles for about a 100-inch log 12*a* as measured in the cross machine direction. In another embodiment, there is at least one nozzle 404 per about every 11 inches of the log 12*a* as measured in the cross machine direction, or per about every 8 inches of the log 12*a* as measured in the cross machine direction. In one embodiment, the number of nozzles 404 is equivalent to the anticipated number finished consumer-sized product units expected to be produced. In other words, if nine finished products were to be created from one log 12*a*, then nine nozzles 404 may be used. In another embodiment, the number of nozzles 404 is greater than the number of anticipated finished consumer-sized product units, as the foaming adhesive 406 does not create the same potential for build up log saws as seen with conventional tail sealers 10. In one nonlimiting example, the nozzles 404 are equidistant from each other. In an alternative nonlimiting example, the distances between adjacent nozzles 404 may vary throughout the plurality. In a further nonlimiting example, each nozzle 404 may be positioned between about 4 inches and about 16 inches, or between about 6 inches to about 12 inches, or between about 6 inches to about 8 inches from a respective spray site upon which it will deposit the foaming adhesive 406 and/or from a table 24*a*. In another embodiment, each nozzle 404 may be positioned about 45 degrees to about 135 degrees relative to the respective spray site upon which it may deposit the foaming adhesive 406 or about 45 degrees to about 135 degrees relative to the table 24*a*. It is believed that in combination at a given pressure, the nozzles 404 may create a relatively long, thin line of adhesive 402.

A line of adhesive 402 may be formed by a combination of the emissions from a plurality of spray guns, which may include one or more nozzles 404 of the present disclosure. In one nonlimiting example, the line of adhesive 402 extends through the width of the log 12*a* and/or the tail 22*a* as measured in the cross machine direction. In one nonlimiting example, the line of adhesive 402 may be formed by overlapping predetermined deposit patterns from nozzles 404 of the present disclosure. In another nonlimiting example, the line of adhesive 402 is formed from adjacent, connecting predetermined deposit patterns from the nozzles 404. In yet another nonlimiting example, the line of adhesive 402 is formed from a series of unconnected predetermined deposit patterns from such nozzles 404. The line of adhesive 402 may also be formed by a combination of the foregoing examples. In yet another embodiment, the line of adhesive 402 is in elongated elliptical pattern.

Without being bound by theory, it is believed that the dimensions of the desired line of adhesive 402 are a function of several factors including the type of spray guns, the number of spray guns, each spray gun's fan angle, the distance of the spray guns from the spray site, the angle of the spray guns relative to a respective spray site, the pressure and velocity at which the foaming adhesive is sprayed, the anticipated pattern of emission of the adhesive (such as the predetermined deposit pattern of a nozzle 404 of the present invention) and the desired density of the adhesive in the line 402. One of skill in the art will recognize that such variables can be adjusted in a number of possible combinations to accomplish the desired line of adhesive 402.

After the line of adhesive 402 is deposited, turn rollers 18*a* may continue to roll, causing the tail 22*a* to rewind and reconnect to the body 13*a*. Alternatively, the body 13*a* and the tail 22*a* may be wound together for the first time after the line of adhesive 402 has been deposited. The body 13*a* and the tail 22*a* may be connected at the line of adhesive 402.

The weight of the log 12*a* may be used to press the tail 22*a* and body 13*a* together. In an alternative embodiment, an arm or other machine part may be used to compress the tail 22*a* and the body 13*a* together. In another nonlimiting example, air and/or a change in pressure can be used to press the tail 22*a* and the body 13*a* together. Those of skill in the art will recognize that such compression may be achieved in different ways.

After the tail 22*a* is reconnected to the log 12*a*, an auxiliary kicker 30*a* may eject the log 12*a* toward the next converting operation—such as an accumulator in-feed. Timers and/or other control features may be used to manage the rate of operation and/or prevent backlog or overfeeding of the logs 12*a* into the tail sealer 10*a*.

Figure 4:
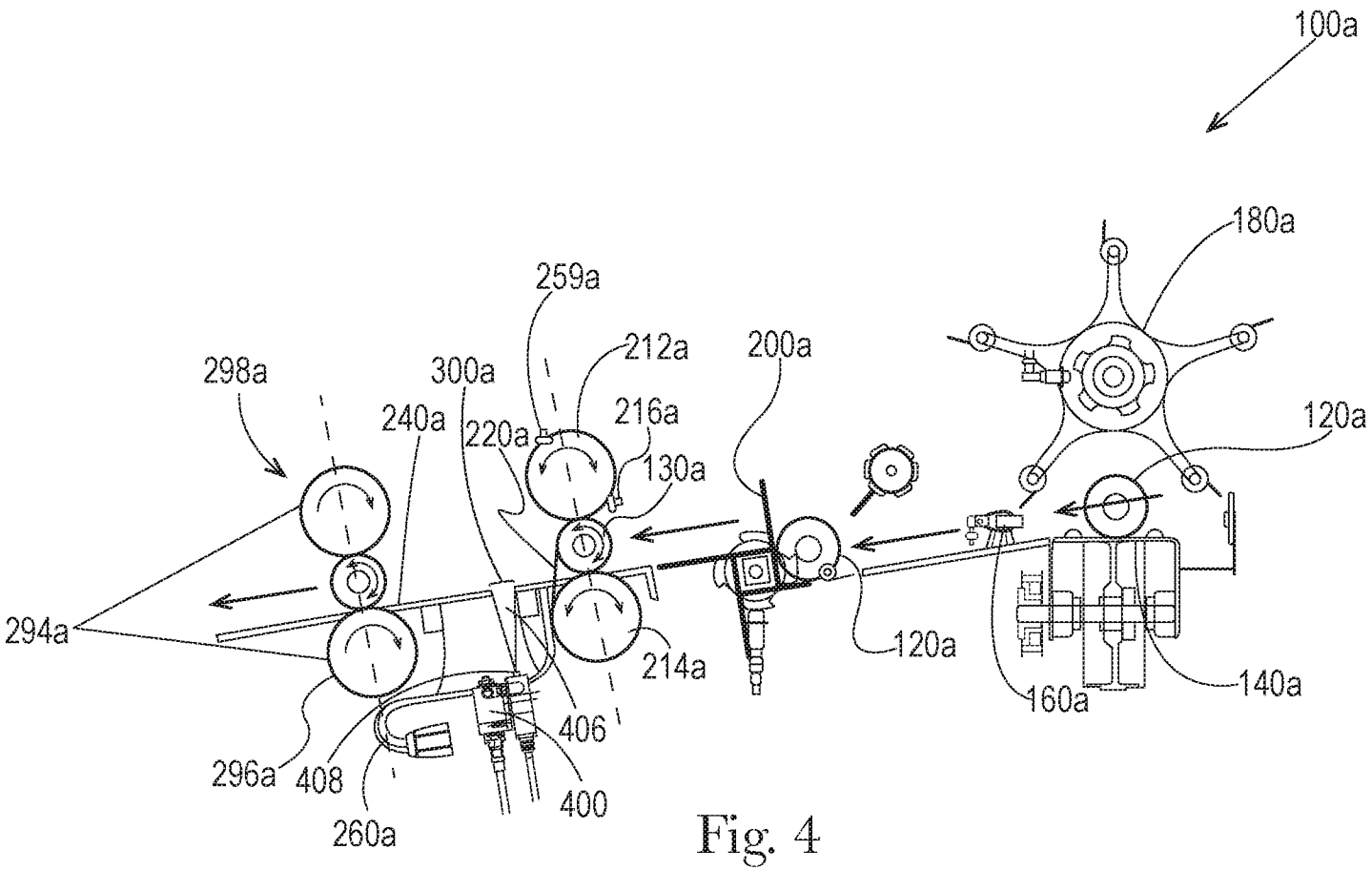
FIG. 4 is a cross-sectional view of an exemplary tail sealing apparatus in accordance with one embodiment of the present disclosure.

In another embodiment, shown in FIG. 4, the nozzle 404 of the present disclosure is inverted such that the nozzle 404 may spray the foaming adhesive 406 in a generally upward direction. The spray site can be positioned generally above the nozzle 404. The inverted spray nozzle 404 may be placed in the area generally where a blade, bar or wire and pan assembly 290 could be found in exemplary typical tail sealers 100.

In one nonlimiting example, as illustrated in FIG. 4, the log 120*a* may enter the tail sealer 100*a* at in-feed conveyor 140*a*. An incoming log detector 160*a* can detect when the log 120*a* is in position on the in-feed conveyor 140*a* and activate a rotary kicker 160*a* to push the log 120*a* off the conveyor 140*a* toward the index paddle 200*a*. The index paddle 200*a* can then receive the log 120*a* and hold it until the in-feed rolls 210*a* are clear. The index paddle 200*a* may then index about 90 degrees, moving the log 120*a* into the in-feed rolls 210*a*. In-feed rolls 210*a* may comprise an upper in-feed roll 212*a* and a lower in-feed roll 214*a* (such as a vacuum roll).

The in-feed rolls 210*a* may initially rotate in the same direction but at mismatched speeds, with the upper in-feed roll 212*a* rotating faster than the lower in-feed (or vacuum) roll 214*a*. The distance of upper in-feed roll 212*a* relative to lower in-feed roll 214*a* can be adjusted to accommodate the log 120*a* diameter. However, upper in-feed roll 212*a* may be positioned to create some interference with the log 120*a*. When the log 120*a* is fed into the in-feed rolls 210*a*, the log 120*a* may be controlled at the top and bottom log 120*a* positions because of the interference and rate of log 120*a* travel is controlled by the speed difference between the in-feed rolls 210*a*. If there is too little or no interference, the log 120*a* could slide through the in-feed rolls 210*a*. Conversely, if there is too much interference, the logs 120*a* may not feed into the in-feed rolls 30*a* correctly and could cause a jam up at the index paddle 200*a*.

As the log 120*a* contacts the in-feed rolls 210*a*, it is pulled into the nip between the in-feed rolls 210*a* by the differential speed. As the log 120*a* reaches the diagonal center of the in-feed rolls 210*a*, it blocks the log in-feed rollers detector 216*a* (e.g., photo eye sensor) at which time the in-feed rolls 210*a* rotate at a matched speed. This holds the log 120*a* in position while an airblast nozzle 259*a* may emit a stream of air to separate the tail 220*a* from the log 120*a* and position the tail 220*a* flat onto the table 240*a* where a tail detector 260*a* (e.g., a PEC) can become blocked by the tail 220*a*. As the log 120*a* rotates and rewinds the separated tail 220*a*, the tail detector 260*a* becomes unblocked when the edge of the tail 220*a* has been located.

After the edge of the tail 220*a* is detected, the tail 220*a* may be rewound onto the body 130*a* until the edge of the tail 220*a* is directly underneath the body 130*a*. The in-feed rolls 210*a* may then stop and reverse direction, resulting in the tail 220*a* unrolling from body 130*a*. The tail 220*a* may then be held by vacuum to the lower in-feed roll 214*a* and follow the lower in-feed roll 214*a* as it is unwound until a calculated length of tail 220*a* has been separated from the body 130*a*. The in-feed rolls 210*a* can then stop and the upper in-feed roll 212*a* can start rotating back in the forward direction to eject the log 120*a* from the in-feed rolls 210*a*. The tail length centerline can control the amount of tail sheet 220*a* that is unwound from the log 120*a* and be adjusted to get the desired tab length. In one nonlimiting example, the tab length is about 1 inch as measured from the edge of the tail 220*a* in the machine direction. The speed of in-feed rolls 210*a* may be adjusted to achieve consistent tail detection. Higher speeds can reduce the time to rotate the log 120*a* but may not increase rate capability. The speed of in-feed rolls 210*a* can be adjusted to consistently detect the tail 220*a* on the first revolution.

In an alternative embodiment, the tail sealer 100*a* may identify the tail 220*a* by using a counting mechanism. In one nonlimiting example, the tail sealer 100*a* is capable of anticipating the tail 220*a* by counting the number of sheets processed through the system. The apparatus 100*a* may count the number of sheets required to produce the desired log 120*a* and identify the tail 220*a* as the last sheet in the count.

After the tail 220*a* is detected, the spray nozzle application system 400 may spray a line of adhesive 402. The spray nozzle application system 400 may be provided underneath a table 240*a*. The log 120*a* may be held stationary while the line of adhesive 402 is being emitted or the log 120*a* may be moving.

In one nonlimiting example, the nozzle 404 may emit a stream of foamed adhesive 406 onto a spray site in a generally upward direction through an aperture 300*a* disposed within table 240*a*. The discharge portion 408 of the nozzle 404 may be configured to emit the foaming adhesive 406 in a predetermined deposit pattern. Such predetermined deposit pattern may form part of the line of adhesive 402. In one nonlimiting example, the discharge portion 408 is configured to spray the foaming adhesive 406 such that it will deposit on a spray site in a generally two-dimensional circular pattern. In another nonlimiting example, the deposit pattern may be generally two-dimensionally ovular. In yet another nonlimiting example, the discharge portion 408 is configured such that the deposit pattern has a two-dimensional shape, such as an oval, egg shape or ellipse, having an aspect ratio (in a two-dimensional context) of about 1.1 or more, or about 2 or more. The aspect ratio is measured as explained above.

The nozzle 404 may be provided at an angle relative to the table 240*a* ranging from about 45 degrees to about 135 degrees in order to allow for the rolling progression of a log 120*a* through the tail sealer apparatus 100*a* and achieve a suitable line of adhesive 402. In another embodiment, the nozzle 404 is positioned at an angle of about 45 degrees to about 135 degrees relative to the spray site. In a further embodiment, the nozzle 404 is positioned from about 1 to about 16 inches from the spray site, or from about 3 to about 4 inches from the spray site. Measurements of such angles and distances are to be performed as explained above.

Figure 5:
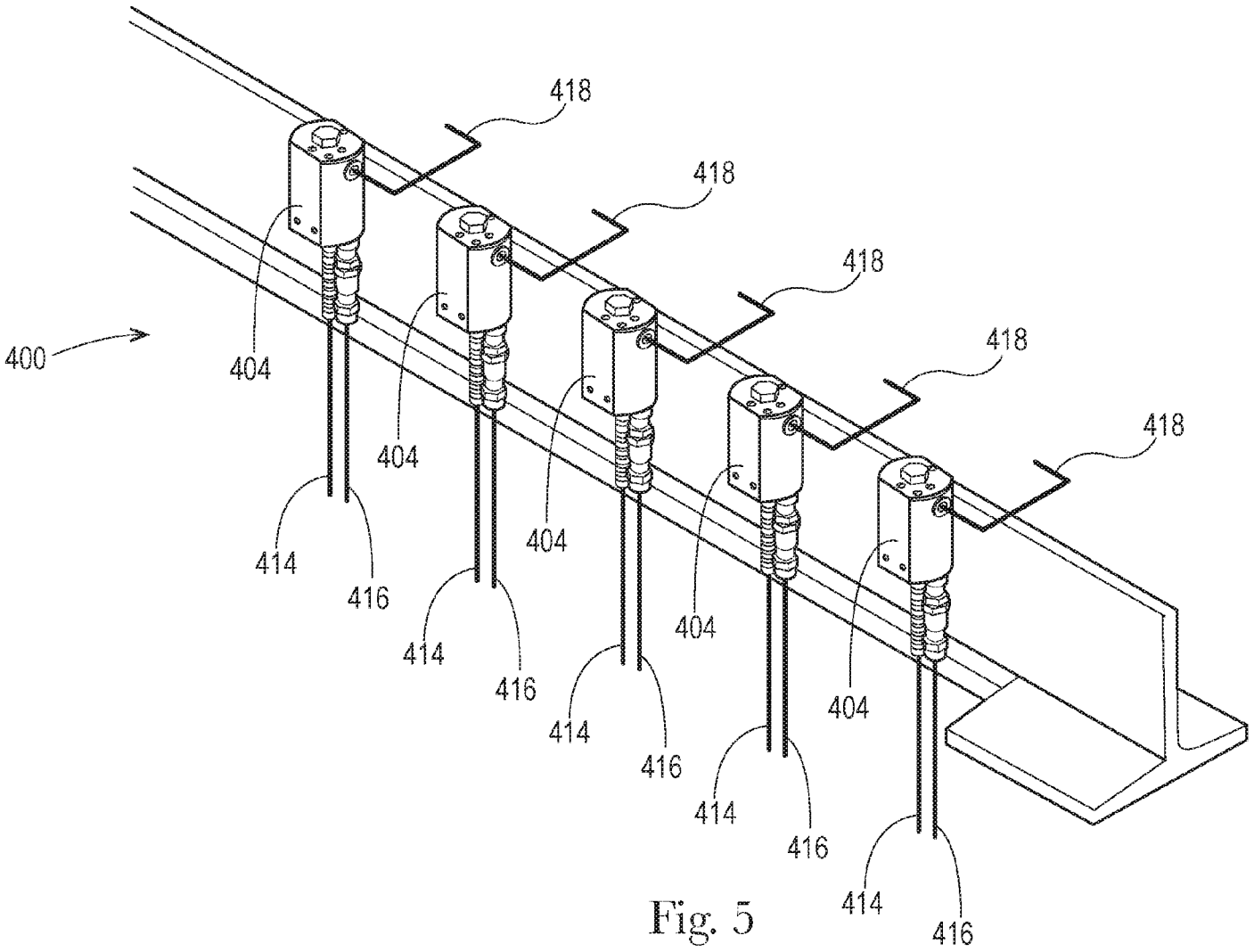
FIG. 5 is a perspective view of a plurality of spray nozzles according to an embodiment of the present disclosure.
Figure 6:
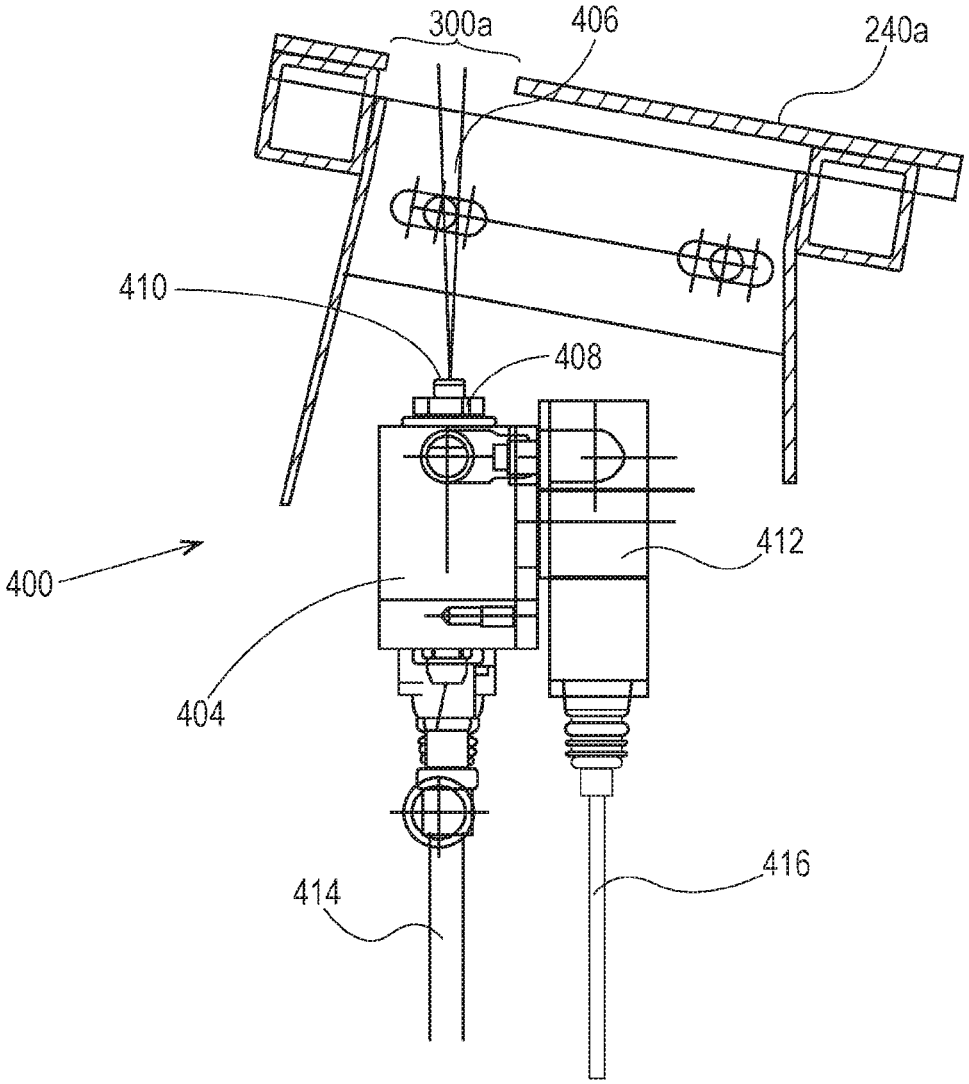
FIG. 6 is a cross-sectional view of a spray nozzle adhesive application system in accordance with one embodiment of the present disclosure.
Figure 8:
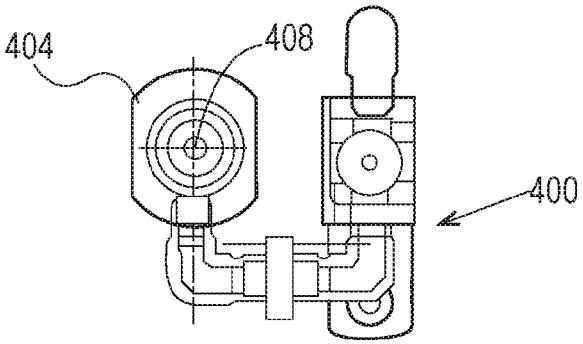
FIG. 8 is a plan view of the spray nozzle system of FIG. 7.
Figure 7:
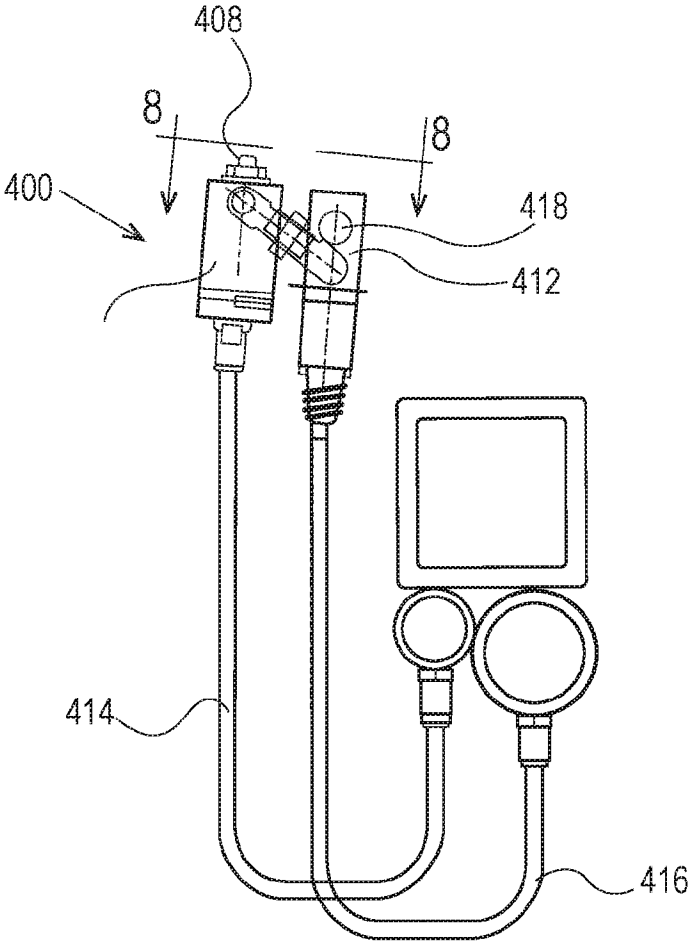
FIG. 7 is a cross-sectional view of an exemplary spray nozzle system in accordance with the present disclosure.

In yet another embodiment, shown in FIG. 5, the spray nozzle application system 400 comprises a plurality of nozzles 404 of the present disclosure that are mounted or otherwise connected to the tail sealing apparatus 100*a* such that are positioned generally beneath the table 240*a* and/or respective spray sites. In another embodiment, the nozzles 404 are substantially spaced apart in a generally linear manner in the cross machine direction. In yet another embodiment, the nozzles 404 may be positioned in a pattern such that they do not form a line in the cross machine direction. In a nonlimiting example, the plurality of nozzles 404 comprises from about 12 to about 33 nozzles 404, or from about 27 to about 33 nozzles 404 for about a 100-inch log 120*a* as measured in the cross machine direction. In another embodiment, there is at least one nozzle 404 per about every 11 inches of the log 120*a* as measured in the cross machine direction. In one embodiment, the number of nozzles 404 is equivalent to the anticipated number of final finished products expected to be produced. In other words, if nine finished products were to be created from one log 120*a*, then nine nozzles 404 may be used. In another embodiment, the number of nozzles 404 is greater than the number of anticipated final finished products, as the foaming adhesive 406 does not create the same potential for build up on the log saw as seen with conventional tail sealers 10, 100. In a nonlimiting example, each nozzle 404 may be positioned between about 1 and about 16 inches, or about 3 to about 4 inches from a respective spray site upon which it will deposit the foaming adhesive 406. In one nonlimiting example, the nozzles 404 are equidistant from each other. In an alternative nonlimiting example, the distances between adjacent nozzles 404 may vary throughout the plurality. In a further embodiment, each nozzle 404 may be positioned about 45 degrees to about 135 degrees relative to the respective spray site upon which it may deposit the foaming adhesive 406 or from about 45 degrees to about 135 degrees relative to the table 240*a*. It is believed that in combination at a given pressure, the nozzles 404 may create a relatively long, thin line of adhesive 402.

A line of adhesive 402 may be formed by a combination of the emissions from a plurality of spray guns, which may include one or more nozzles 404 of the present invention. In one nonlimiting example, the line of adhesive 402 extends through the width of the log 120*a* and/or the tail 220*a* as measured in the cross machine direction. In one nonlimiting example, the line of adhesive 402 may be formed by overlapping predetermined deposit patterns from nozzles 404 of the present disclosure. In another nonlimiting example, the line of adhesive 402 is formed from adjacent, connecting predetermined deposit patterns from the nozzles 404. In yet another nonlimiting example, the line of adhesive 402 is formed from a series of unconnected predetermined deposit patterns from such nozzles 404. The line of adhesive 402 may also be formed by a combination of the foregoing examples. In yet another embodiment, the line of adhesive 402 is in elongated elliptical pattern.

Without being bound by theory, it is believed that the dimensions of the desired line of adhesive 402 are a function of several factors including the type of spray guns, the number of spray guns, each spray gun's fan angle, the distance of the spray guns from the spray site, the angle of the spray guns relative to a respective spray site, the pressure and velocity at which the foaming adhesive is sprayed, the anticipated pattern of emission of the adhesive (such as the predetermined deposit pattern of a nozzle 404 of the present invention) and the desired density of the adhesive in the line 402. One of skill in the art will recognize that such variables can be adjusted in a number of possible combinations to accomplish the desired line of adhesive 402.

After application of the foaming adhesive 406, the log 20*a* may roll down the table 240*a* to the out-feed rolls 210*a* which may press the tail 220*a* to the body 130*a*. The body 130*a* may be reconnected to the tail 220*a* at the line of adhesive 402. The lower out-feed roll 296*a* may run slower than the upper out-feed roll 298*a*, causing the log 120*a* to move through the out-feed rolls 294*a* for a controlled duration, similar to the in-feed rolls 210*a*. The speed of lower out-feed roll 296*a* may be controlled as a percentage of the speed of upper out-feed roll 298*a*. Increasing the setting will more closely match the upper out-feed roll 298*a* and lower out-feed roll 296*a* speeds. This can hold the log 120*a* in the out-feed rolls 294*a* longer.

When the log 120*a* is released from the out-feed rolls 294*a*, it can roll down the table 240*a* to the next converting operation—typically an accumulator in-feed.

In an alternative embodiment, the tail 220*a* and body 130*a* may be compressed using an arm or other type of machine part to press pieces together. In another nonlimiting example, air and/or a change of pressure may be used to cause the body 130*a* and the tail 220*a* to press together. One of skill in the art will recognize that compression can be achieved in different ways.

In yet another embodiment, the body 130*a* and the tail 220*a* may be wound together for the first time after the line of adhesive 402 has been deposited. The body 130*a* and the tail 220*a* may be connected at the line of adhesive 402.

The spray nozzle application system 400 of the present disclosure may bond the tail 220*a* at a rate that allows the tail sealer 100*a* to process logs 120*a* at a rate not less than 20 logs processed/minute, or at a rate between about 30 logs processed/minute to about 60 logs processed/minute, or from about 50 logs processed/minute to about 60 logs processed/minute. It was discovered that technical improvements of the adhesive components of the tail sealer 100*a* did not result in rate reduction. This solves the problem of the expected rate decrease based on improvements to the adhesive system.

As one of skill in the art will recognize, other arrangements of portions of the exemplary tail sealers 10*a*, 100*a* can be used. For instance, the relative speeds of the upper in-feed rolls 212*a* and lower in-feed rolls 214*a* may be changed, the table 24*a*, 240*a* placement as well as the presence of a log in-feed section, log index to sealing station, tail identifying, tail winding and log discharge portions may be modified. As a nonlimiting example, belts may be used in lieu of rolls. Likewise, the angles and distances of the nozzle 404 relative to the spray site and/or table 24*a*, 240*a* may be altered as may the application pressure or velocity. Additionally, timers and/or other control features may be used to manage the rate of operation and/or prevent backlog or overfeeding of the logs 12*a*, 120*a* into the tail sealer 10*a*, 100*a*.

Further, the skilled person can recognize different arrangements, presentation or placement of the various components of this disclosure may be used to achieve the desired density of adhesive 406 and/or line of adhesive 402.

Foamed Adhesive Spray Nozzle

FIGS. 6-9 illustrate an exemplary spray nozzle application system 400 shown in a configuration where the foamed adhesive 406 would be sprayed in a generally upward position. The spray nozzle application system 400 generally may comprise a nozzle 404, air valve 412, adhesive supply 414, inert gas (e.g., air) supply 416 and control lines 418. It was found that the nozzle 404 and an air valve 412 could be intimately connected so that the solenoids disposed within the air valve 412 may control the rate of inert gas entering the chamber of the nozzle 404 in a controlled fashion. This control was found suitable to allow for the production of convolutely wound logs 12*a*, 120*a* of web material in traditional bath tissue and paper toweling manufacturing operations.

In function, an inert gas may be presented at the outside position of a solenoid provided internally to air valve 412. As a log 12*a*, 120*a* is detected by the tail identifying system, the solenoid within the air valve 412 may open and pressurize the nozzle 404 with inert gas from the inert gas supply 416. Another solenoid disposed internally to the nozzle 404 may then open to allow the egress of adhesive from the adhesive supply 414 and inert gas from the inert gas supply 416 into the nozzle 404 where integral mixing can occur.

Figure 9:
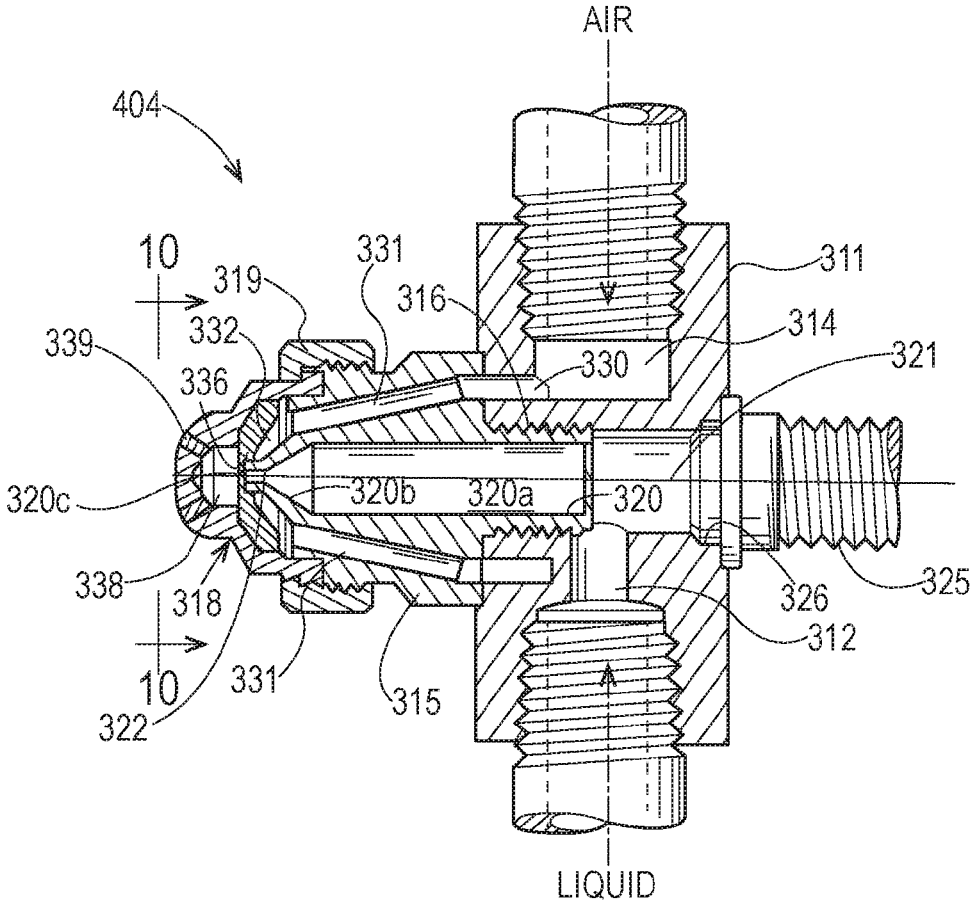
FIG. 9 is a cross-sectional view of an exemplary nozzle suitable for use with the present disclosure.
Figure 10:
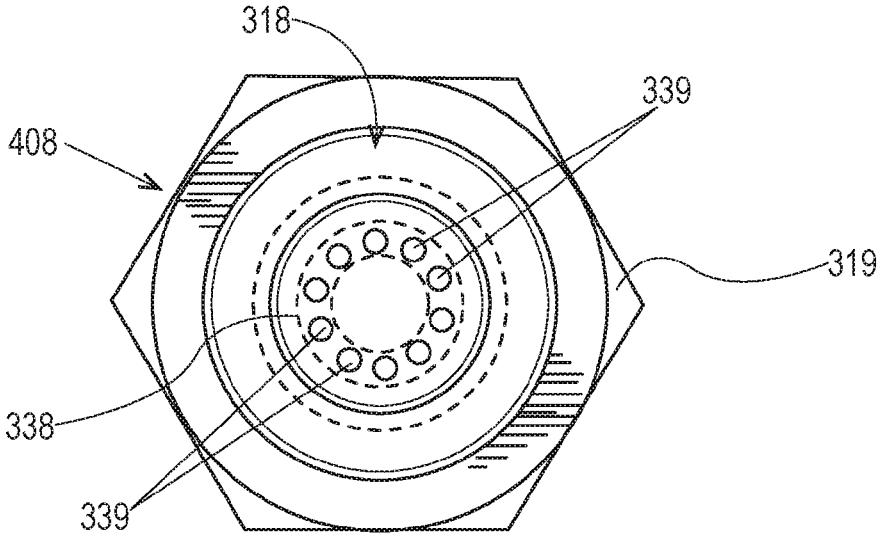
FIG. 10 is a plan view of the exemplary nozzle of FIG. 9.

Referring now to FIGS. 9-10, there is shown one non-limiting example of a foam generating nozzle 404 in accordance with the present invention. The nozzle 404 may include a nozzle body 311 formed with diametrically opposed liquid inlet 312 and pressurized air inlet ports 314, a nozzle spray tip 315 affixed to the forward or downstream end of the nozzle body 311 by a threaded stem 316 of the nozzle spray tip 315, and an air cap 318 disposed in surrounding relation to the nozzle spray tip 315 and retained thereon by a retaining nut 319. The nozzle spray tip 315 may have a liquid passageway 320 extending along a central axis 321 of the nozzle 404 and communicating with the liquid inlet port 312. The liquid passageway 320 may include a relatively large diameter upstream portion 320*a* and an inwardly tapered conical portion 320*b* that communicates with a relatively small diameter discharge orifice 320*c* formed in a forwarding extending relatively small diameter, cylindrical nose portion 322 of the nozzle spray tip 315.

The nozzle 404 can be mounted to a rod 325 positioned into a mounting opening 326 in a rear side of the nozzle body 311 in coaxial alignment with the central liquid passageway 320. It will be appreciated by one skilled in the art that alternatively the nozzle body 311 can be supported by other means and the central rear opening 326 may receive a valve needle for controlling the liquid flow through the spray nozzle 404 under the control of a pneumatically actuated piston, such as disclosed in U.S. Pat. No. 5,899,387. While in the illustrated embodiment, the nozzle body 311 and nozzle spray tip 315 are separate parts, it also will be understood that alternatively they may be formed as an integral single part.

The air inlet port 314 in this instance communicates with a first annular air chamber 330 defined between the nozzle body 311 and nozzle spray tip 315, which in turn communicates with a plurality of inwardly tapered air passageways 331 formed in the nozzle spray tip 315 in circumferentially spaced relation about the central liquid passageway 320. The nozzle spray tip air passageways 331 each communicate with a second air chamber 332, which may be conically configured and annular. The second air chamber 332 may be defined between the upstream side of the air cap 318 and a downstream inwardly tapered end of the nozzle spray tip 315.

In one embodiment, the air cap 318 has a central opening 335 disposed in surrounding relation to the spray tip nose portion 322, which defines an annular air orifice 336 that communicates between the tapered second air chamber 332 and an internal mixing chamber 338 of the air cap 318.

The air cap 318 may be further formed with the plurality of circumferentially spaced discharge orifices 339 which each communicate with the internal air cap mixing chamber 338. Hence, the direction of pressurized liquid and air to the inlet ports 312, 314, respectfully, can result in the simultaneous discharge of liquid from the nozzle spray tip discharge orifice 320*c* and pressurized air from the annular air discharge orifice 336 for intermixing within the mixing chamber 338 and ultimate discharge through the plurality of the air cap discharge orifices 339.

In accordance with one aspect of the illustrated embodiment of the invention, the air cap internal mixing chamber 338 may be larger in diameter than the annular air discharge orifice 336 so as to permit enhanced intermixing and pre-atomization of the pressurized liquid and air streams directed into the internal mixing chamber 338 prior to discharge from the circumferentially spaced air discharge orifices 339. The air cap mixing chamber 338 may have a diameter of at least 30% greater than the outer diameter of the annular air discharge orifice 336, or at least 50% greater, so as to permit intermixing of the liquid and air streams in an area both downstream and radially outwardly of the pressurized liquid and air streams directed into the mixing chamber 338. In the illustrated embodiment, the internal air cap mixing chamber 338 may be defined by a cylindrical wall 341 of the air cap 318 having a conically configured downstream end 342 and an annular insert 344 positionable in an upstream end of the air cap 318 that defines the central air cap opening 336.

The air cap discharge orifices 339 can extend in skewed relation to the central axis 321 of air cap 318 and nozzle spray tip liquid passageway 320, which unexpectedly has been found to minimize negative pressures between the discharging flow streams and reduce undesirable bearding of solid particulate material on external surfaces of the air cap 318, while enhancing intermixing of the flow streams discharging from the air cap discharge orifices 339. As used in the specification and claims, the term "skewed" means that the axes 340 of the discharge orifices 339 are oriented at an compound angle with respect to the central air cap and liquid passageway axis 321, namely at an acute angle both to a horizontal plane extending through the central axis 321 of the nozzle and a vertical plane extending through the central axis 321 of the air cap 318. With the flow streams discharging from the air cap 318 directed both radially and tangentially with respect to the central air cap axis 321, the fine pre-atomized liquid particles tend to migrate more readily into a full cone spray pattern.

In keeping with still a further feature of this embodiment of the invention, the relatively large diameter internal air cap mixing chamber 338 and the skewed relation of the air cap discharge orifices 339 enable the air cap 318 to be formed with a greater number of discharge orifices 339, which may additionally facilitate intermixing of the discharging liquid particles into a full spray pattern with reduced negative pressures between the discharging flow streams. The closer spacing between the skewed discharge orifices 339 is believed to both facilitate intermixing of the discharging flow stream into a conical spray pattern and minimize negative pressure between the discharging flow streams which otherwise create undesirable bearding of solid particulate material on the air cap 318.

The nozzle 404 design permits foaming adhesive 406 to be generated just before emission, such that foam 406 will not need to be stored within the nozzle 404 for a period of time. Storage of foam 406 inside a nozzle could lead to difficulties in generating additional foam due to lack of available space and build up from foam 406 residue.

The referenced nozzle 404 may be provided with a fluid at about 10 psi to about 60 psi and air at about 10 psi to about 60 psi.

A nozzle suitable for use with the tail sealer 10*a*, 100*a* for the present disclosure is Pulse-Jet AA10000JJAU-VI (applicator nozzle gun) in combination with applicator tip parts PFJ60100-SS FLUID CAP,SS,1/8JJ and SPECCP98327-SS SPECIAL 70DEGREE AIR CAP, all of which are available from Spraying Systems Co. One of skill in the art will recognize that the nozzles of the present invention may be used in combination with other known sprayers.

Foaming Adhesive

A suitable adhesive 406 for the present invention may be aqueous and capable of forming a fine bubble foam when pressurized or otherwise atomized at the conditions discussed above. It may also comprise preservatives. In an embodiment, the adhesive 406 may comprise foaming control agents to control the type and amount of foam.

The adhesive 406 may be water-based. In another embodiment, the adhesive 406 may comprise polyvinyl alcohol. In an alternative embodiment, the adhesive 406 may be starch-based, such as a polysaccharide or polyhydroxyl composition. Typically, polyvinyl alcohol-based and starch-based adhesives are known to demonstrate poor releasability, which can result in negative feedback when end users attempt to remove the tail 22*a*, 220*a* from the body 13*a*, 130*a*. It was surprising found, however, that polyvinyl alcohol or starch-based adhesives in combination with a foaming agent as used in the present disclosure work well as a tail sealing adhesive 406 due to reasons discussed below.

The adhesive 406 may have a viscosity of about 450 cps to about 550 cps, or about 500 cps, at point of delivery into the nozzle 404. The adhesive 406 may have a pH of about 2.5 to about 5.5, or from about 3 to about 5, or a pH of about 4. The adhesive 406 can have about 30% to about 44% solids content, or about 36% to about 38% solids content, or about 37% solids content. Typical tail seal adhesives (outside of the scope of the present invention) may comprise 3-15% solids. Nonlimiting examples of suitable adhesives are TT5000B®, TT5000BX® or TT5001®, all of which are available from HB Fuller Company.

In one embodiment, air is provided as the gas material and/or foaming agent.

It is believed that foaming the adhesive 406 significantly increases adhesive efficiency for a combination of reasons. First, the density of any given volume of adhesive 406 is reduced by replacing it with a gas (e.g., air), so the amount of adhesive 406 used may be decreased compared to typical tail sealing adhesives. Second, the foamed adhesive 406 is distributed in droplets, each droplet having less glue than particles of non-foaming adhesives. The viscosity and consistency of the adhesive 406 results in the size of each droplet being more uniform as compared to non-foaming tail seal adhesives. Third, the droplets' lower density permits the droplets to be distributed onto the web material in a generally uniform manner when emitted from the nozzle 404 versus a distribution of a non-foaming adhesive. As such, the foaming adhesive 406 can reach more surface area than a non-foamed adhesive.

Fourth, foaming adhesive 406 may comprise significantly less water than comparative non-foaming adhesives. Indeed, because less adhesive is used and faster drying times are achievable, adhesive formulations that typically would result in excessive bonding and releasability issues, such as polyvinyl alcohols and starches, can be used successfully. As a result, less water may be used. Moreover, the increased solid content versus non-foaming adhesives may result in up to about 75% less water being used.

Fifth, the foamed adhesive 406 may permit drying at a relatively fast rate compared to known tail sealing processes. In one nonlimiting example, the foamed adhesive 406 of the present disclosure may dry within about 1 minute to about 5 minutes, or about 1 minute to about 2 minutes. It is believed that the rapid drying is a function of the structure of the foam 406, which generally may have more uniform particle size compared to non-foamed adhesive. The uniform particle size is believed to permit more consistent and thorough drying as each particle is expected to dry in generally the same amount of time. Moreover, it is believed that the foam 406 structure permits internal and external drying because air is entrapped inside each particle and air flows on the outside of each particle as well. Such dual internal/external drying may permit accelerated drying when compared to non-foamed adhesive. In addition, the reduced water content contributes to quicker drying as well. The faster drying time permits maximum bonding during the converting processes as opposed to typical tail seal adhesives which achieve maximum bond strength after such processes are complete.

Sixth, the reduced water content in each droplet and lower density enables each droplet to stay more on the surface of the web substrate where bonding is desired. Non-foaming adhesives tend to be pulled into the web material by capillary forces which pull water and thereby adhesive into the structure of the sheet. Adhesive within the structure of the web material is unavailable or significantly less available for bonding, causing adhesive benefits to be significantly reduced.

All of these factors result in increased adhesive efficiency compared to existing tail glue processes. In other words, more effective bonding may be achieved with less adhesive. In one nonlimiting example, adhesive quantity was reduced by about 80 to about 90% as compared to known tail sealing adhesives. Such increased adhesive efficiency is achievable even where there is limited available bonding area. Moreover, the use of less adhesive 406 as well as lighter density adhesive 406 (as compared to non-foaming adhesives) results in less potential for build up on log saws used to cut logs 12*a*, 120*a* into finished consumer-sized product units.

In one embodiment, the available bonding area is limited by Z-direction textures on the web material, such as texture created by embossing. In one nonlimiting example, the convolutely wound material 600 has a peak 602 and a valley 604. In some instances, the peak 602 is the only available bonding area as the valley 604 is positioned too far away from body 13*a*, 130*a* and/or tail 22*a*, 220*a* to which it is being bonded and/or because the pressure used for compressing the body 13*a*, 130*a* and/or tail 22*a*, 220*a* is not sufficient to allow the valley 604 to reach the area to which it is to be bonded. This is especially true in instances where only the weight of the log 12*a*, 120*a* provides compression pressure for pressing the tail 22*a*, 220*a* and the body 13*a*, 130*a* together. The foaming adhesive 406, for the reasons described herein, may increase the number of adhesive contact points on the surface of the peak 602, within a given spray site of the web material. As a result, more efficient bonding may be achieved as compared to non-foaming adhesive.

It is also believed that the faster dry time reduces the tackiness of the adhesive in a manner that significantly reduces the amount of time that any airborne contaminants (such as debris and dust) have the opportunity to contaminate the applied adhesive. It is also believed that the use of inert gas in a mechanical foaming process is a more sustainable solution than chemical multicomponent foaming processes, many of which produce VOCs or employ isocyanates.

Method of Applying Foaming Adhesive

Figure 11:
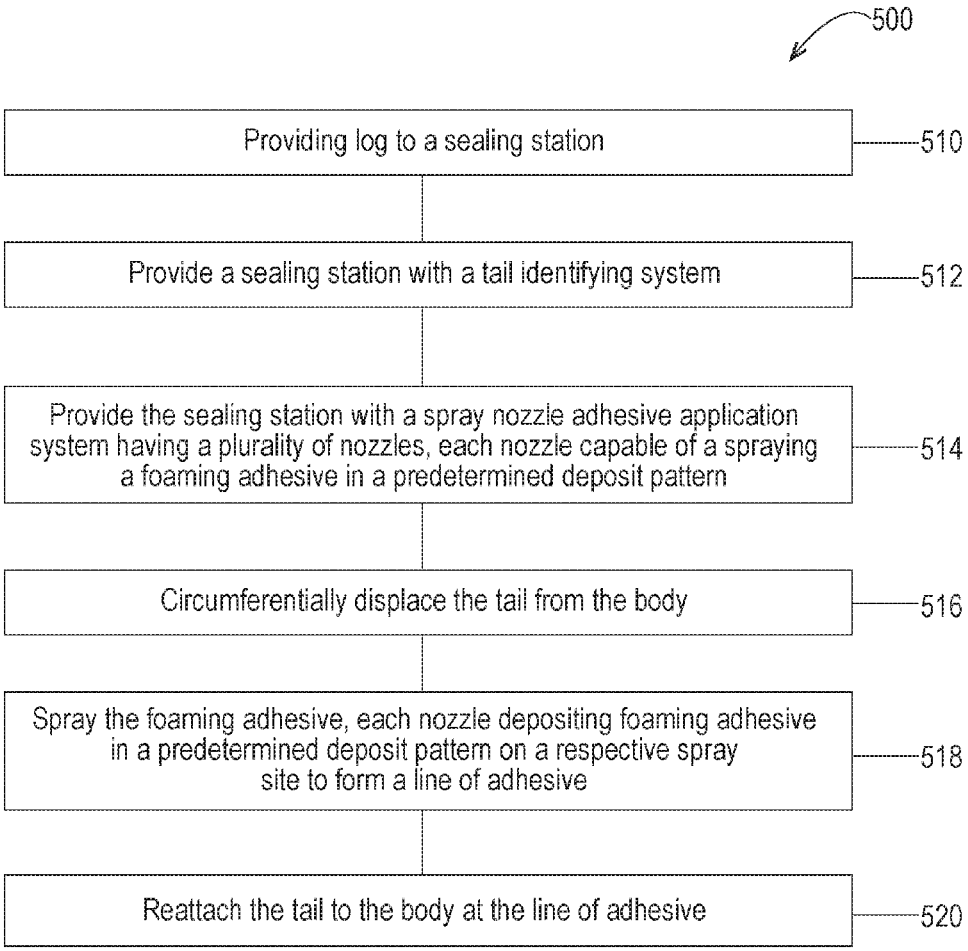
FIG. 11 is a schematic representation of a method for tail sealing according to an embodiment of the present disclosure.

In one embodiment of the present disclosure, a method 500 for tail sealing is provided. A schematic illustration of the steps that may be involved is shown in FIG. 11. The steps may be performed in the order disclosed or in any other order suitable for tail sealing a convolutely wound log of web material 12*a*, 120*a*. An initial step 510 may comprise providing a convolutely wound log 12*a*, 120*a* to a sealing station or another suitable portion of a tail sealer. In one embodiment, the method 500 includes a sealing station step 512, comprising providing a sealing station having a tail identifying system. The sealing station may further comprise a tail positioning component capable of circumferentially displacing the tail 22*a*, 220*a* from the body 13*a*, 130*a* by, for example, emitting air or liquid to displace the tail 22*a*, 220*a*. In another nonlimiting example, the tail identifying system may include an arm or other suitable structure to push or pull the tail 22*a*, 220*a* away from the body 13*a*, 130*a*. In yet another nonlimiting example, the tail identifying system may include a vacuum or similar suction apparatus which may draw the tail 22*a*, 220*a* away from the body 13*a*, 130*a*. The tail positioning component may be part of the tail identifying system.

The method 500 may further comprise a spray system step 514 of providing the sealing station with a spray nozzle adhesive application system 400. The spray nozzle adhesive application system 400 may be capable of spraying a line of adhesive 402. The spray nozzle adhesive application system 400 may also comprise a plurality of nozzles 404, each nozzle 404 capable of spraying a foaming adhesive 406 in a predetermined deposit pattern. The method 500 may also comprise a displacing step 516 of circumferentially displacing the tail 22*a*, 220*a* from the body 13*a*, 130*a*. In one nonlimiting example, the displacing step 516 may be accomplished using the tail positioning component.

In another embodiment, the displacing step 516 is unnecessary as the tail 22*a*, 220*a* and the body 13*a*, 130*a* are not initially connected and therefore they do not require separation. In one nonlimiting example, the tail 22*a*, 220*a* may be identified by using a counting mechanism. The tail sealer 10*a*, 100*a* may be capable of anticipating the tail 220*a* by counting the number of sheets processed through the system and identify the tail 220*a* as the last sheet in the count necessary to complete the log 12*a*, 120*a*.

The method 500 may further include a foam spray step 518 comprising spraying the foaming adhesive 406, where a nozzle 404 sprays the foaming adhesive 406 in a predetermined deposit pattern at a respective spray site to form a line of adhesive 402. The method 500 may also comprise a reattachment step 520 of reattaching the tail 22*a*, 220*a* to the body 13*a*, 130*a* at the line of adhesive 402. The reattachment step 520 may be accomplished through a tail winding system.

In one nonlimiting example, the predetermined deposit pattern of the foaming adhesive 406 is generally a two-dimensional circular or ovular pattern. In another nonlimiting example, the predetermined deposit pattern of the foaming adhesive 406 comprises a shape having an aspect ratio of about 1.1 or more, or about 2 or more as measured above.

In another embodiment, the nozzle 404 is positioned at an angle of about 45 degrees to about 135 degrees relative to a respective spray. In another embodiment, the nozzle 404 is positioned at an angle of about 45 degrees to about 135 degrees relative to a table 24*a*, 240*a*, which may be provided as part of the sealing station. In yet another embodiment, the nozzle 404 is positioned from about 4 to about 16 inches, or from about 6 inches to about 12 inches, or from about 6 inches to about 8 inches from the respective spray site. In yet another embodiment, the nozzle is positioned from about 4 to about 16 inches, or from about 6 inches to about 12 inches, or from about 6 inches to about 8 inches from the table 24*a*, 240*a*, which may be provided as part of the sealing station.

In another embodiment, the foam spray step 518 includes a plurality of nozzles 404, where the nozzles 404 may be substantially spaced apart in a generally linear manner in the cross machine direction. In another embodiment, the nozzles 404 may be positioned in a pattern such that they do not form a straight line in the cross machine direction. In one nonlimiting example, the plurality of nozzles 404 comprises from about 9 to about 12 nozzles for about a 100-inch log 12*a*, 120*a* as measured in the cross machine direction. In another embodiment, there is at least one nozzle 404 per about every 11 inches of the log 12*a*, 120*a* as measured in the cross machine direction, or per about every 8 inches of the log 12*a*, 120*a* as measured in the cross machine direction. In one embodiment, the number of nozzles 404 is equivalent to the anticipated number of final finished products expected to be produced. In other words, if nine finished consumer-sized product units were to be created from one log 12*a*, 120*a*, then nine nozzles 404 may be used. In another embodiment, the number of nozzles 404 is greater than the number of anticipated final finished products. In a nonlimiting example, each nozzle 404 may be positioned between about from about 4 to about 16 inches from a respective spray site, or from about 6 inches to about 12 inches, or from about 6 inches to about 8 inches from the spray site upon which it will deposit the foaming adhesive 406 and/or from a table 24*a*, 240*a* which may be provided as part of the sealing station. It is believed that in combination at a given pressure, the nozzles 404 may create a relatively long, thin line of adhesive 402.

In an alternative embodiment, the spray system step 514 may involve providing the spray nozzle application system 400 in an inverted position, such that the nozzle 404 is positioned to emit the foaming adhesive 406 in a generally upward direction. The nozzle 404 may be provided at an angle relative to a table 240*a* (which may be provided as part of the sealing station) ranging from about 45 degrees to about 135 degrees. In another embodiment, the nozzle 404 is positioned at an angle of about 45 degrees to about 135 degrees relative to its respective spray site. In a further embodiment, the nozzle 404 may be positioned from about 1 to about 16 inches from the respective spray site, or from about 3 to about 4 inches from the respective spray site.

In yet another embodiment, the foam spray step 518 may involve a plurality of inverted nozzles 404, where the nozzles 404 are substantially spaced apart in a generally linear manner in the cross machine direction. In a nonlimiting example, the nozzles 404 may be positioned in a pattern such that they do not form a straight line in the cross machine direction. In another nonlimiting example, the plurality of nozzles 404 comprises from about 12 to about 33 nozzles 404, or from about 27 to about 33 nozzles 404 for about a 100-inch log 12*a*, 120*a* as measured in the cross machine direction. In another embodiment, there is at least one nozzle 404 per about every 11 inches of the log 12*a*, 120*a* as measured in the cross machine direction. In one embodiment, the number of nozzles 404 is equivalent to anticipated number of final finished products expected to be produced. In other words, if nine finished consumer-sized product units were to be created from one log 12*a*, 120*a*, then nine nozzles 404 may be used. In another embodiment, the number of nozzles 404 is greater than the number of anticipated final finished products. In a nonlimiting example, each nozzle 404 may be positioned between about 1 and about 16 inches, or from about 3 to 4 inches from the respective spray site upon which it will deposit the foaming adhesive 406. In another embodiment, each nozzle 404 may be positioned about 45 degrees to about 135 degrees relative to respective spray site upon which it may deposit the foaming adhesive 406. It is believed that in combination at a given pressure, the nozzles 404 may create a relatively long, thin line of adhesive 402.

In one embodiment, the method 500 is performed at a rate of not less than 20 logs processed per minute, or at a rate between about 30 logs processed per minute to about 60 logs processed per minute, or from about 50 logs processed per minute to about 60 logs processed per minute.

Product Tail Sealed with Foaming Adhesive

In one embodiment of the present disclosure, a convolutely wound material has a tail 22*a*, 220*a* and a body 13*a*, 130*a*. The tail 22*a*, 220*a* and the body 13*a*, 130*a* may be bonded with a foaming adhesive 406. The foaming adhesive 406 may be deposited on the tail 22*a*, 220*a* and/or the body 13*a*, 130*a*. The foaming adhesive 406 may be emitted in a predetermined deposit pattern. The predetermined deposit pattern may be generally two-dimensional circular or ovular pattern. The predetermined deposit pattern may have shape with an aspect ratio of about 1.1 or more, or about 2 or more. In another embodiment, the tail portion 22*a*, 220*a* and body portion 13*a*, 130*a* are bonded by a line of adhesive 402.

In one nonlimiting example, the convolutely wound web material 600 is a fibrous structure. The material 600 may be provided as a single-ply or multi-ply sanitary tissue product. In another nonlimiting example, the sanitary tissue product may be a paper towel product or a bath tissue product. The sanitary tissue product may comprise embossing or otherwise comprise textural elements such as peaks 602 or valleys 604.

Figure 12:
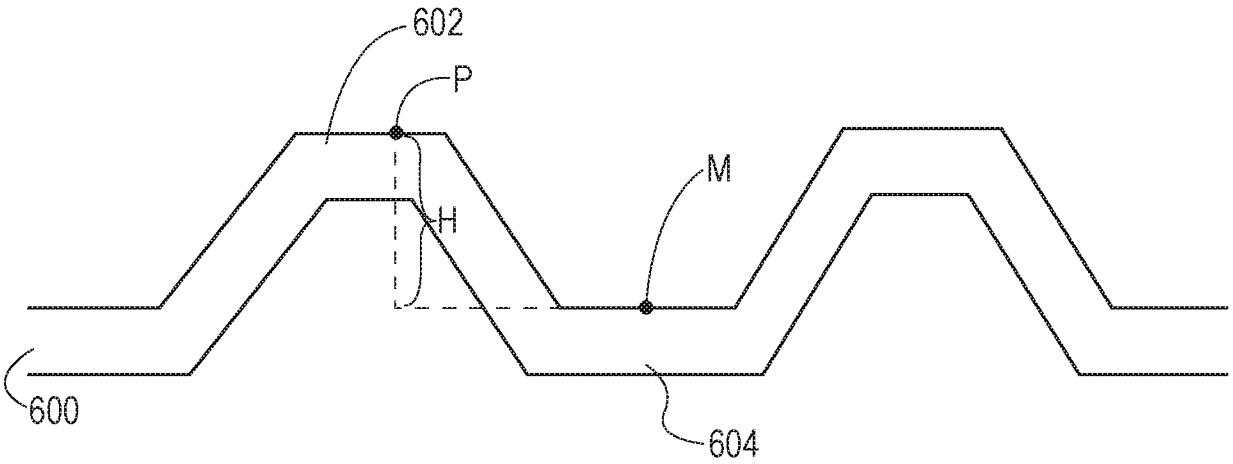
FIG. 12 is a schematic representation of an exemplary material according to one embodiment of the present disclosure.

As shown in FIG. 12, the material 600 may have a peak 602 and a valley 604. The peak 602 and/or valley 604 may be formed at various stages during the process of making the web material 600. In one nonlimiting example, creping may cause such peaks 602 and/or valleys 604 in a fibrous structure. Likewise, the peaks 602 and/or valleys 604 may be wet-formed, (occurring while the fibers of a fibrous structure are wet) by, for example, a belt having particular shapes or holes. In another nonlimiting example, the peaks 602 and/or valleys 604 of a fibrous structure may be dry-formed (i.e., formed after the fibrous structure is dry) which typically occurs during converting processes such as embossing. In another nonlimiting example, the peaks 602 are formed as a by-product of the formation of valleys 604 in the material 600. Similarly, the valleys 604 may be formed as a by-product of the formation of peaks 602 in the material 600.

Generally, the peaks 602 and valleys 604 extend in opposite directions in Z-direction. In one nonlimiting example, a peak 602 extends upward in the Z-direction. The valley 604 in this case may extend downward in the Z-direction, away from the peak 602. In one embodiment, the peak 602 is located on the tail 22*a*, 220*a*. In another embodiment, the peak 602 is located on the body 13*a*, 130*a* (i.e., the non-tail portion). Alternatively, the peaks 602 may be found on both the body 13*a*, 130*a* and the tail 22*a*, 220*a*. Likewise, valleys 604 may be located on the tail 22*a*, 220*a*, the body 13*a*, 130*a* or both the portions of the web material 600. The peaks 602 and/or valleys 604 may be found on one or multiple sides of the material 600. Where multiple peaks 602 are found on the material 600, said peaks 602 may comprise different heights, shapes and/or sizes. Likewise, where multiple valleys 604 are found on a material 600, the valleys 604 may comprise different heights, shapes and/or sizes.

In one nonlimiting example, a peak 602 and valley 604 are adjacent and have a maximum height distance, H, of about 365 microns to about 1750 microns between them. In another nonlimiting example, the maximum height distance, H, is from about 180 microns to about 730 microns. The height distance is measured by measuring distance between the furthest points on the peak 602 and the valley 604 in the Z-direction. In one nonlimiting example, as shown in FIG. 12, the peak 602 has a maximum height, P, as measured in the Z-direction when the material 600 having the peak 602 is laid against a flat surface. In such instance, P is measured from the point furthest away from the flat surface in the Z-direction. An adjacent valley 604 may have a minimum height, M, which may be the furthest point from P in the Z-direction within the valley 604. The maximum height distance, H, would be the distance from P to M, along the Z-axis.

In some instances, the peak 602 is the only available bonding area because the valley 604 is positioned too far away from body 13*a*, 130*a* and/or tail 22*a*, 220*a* to which it is being bonded and/or because the pressure for compressing the body 13*a*, 130*a* and/or tail 22*a*, 220*a* is not sufficient to allow the valley 604 to reach the area to which it is being bonded. This is especially true in instances where only the weight of the log 12*a*, 120*a* provides compression pressure for pressing the tail 22*a*, 220*a* and the body 13*a*, 130*a* together. The foaming adhesive 406, for the reasons described herein, may increase the number of adhesive contact points on the surface of the peak 602, within a given spray site of the web material. As a result, more efficient bonding may be achieved as compared to non-foaming adhesive.

In one embodiment, the foaming adhesive 406 is uniformly distributed, such that a sufficient number of bonding sites exist on the peak 602 to ensure maximum bonding of the tail 22*a*, 220*a* to the body 13*a*, 130*a* within about 1 minute to about 10 minutes, or within about 1 minute to about 5 minutes, or within about 1 minute to about 2 minutes after application.

Once cut into consumer-sized product units of 11-inch width, the convolutely wound log 12*a*, 120*a* having its tail 22*a*, 220*a* bonded with foaming adhesive 406 in accordance with the present disclosure may have a peel strength ranging from about 50 g/11 inch roll to about 400 g/11 inch roll, or from about 80 g/11 inch roll to about 300 g/11 inch roll, or from about 100 g/11 inch roll to about 200 g/11 inch roll as determined by the Wet Tail Seal Strength Test described herein. In one embodiment, rolls having a consumer-sized product unit different than 11 inches may have a peel strength equating to the product of the width of the consumer unit in inches multiplied by a factor of about 4.5 g/inch to about 36.4 g/inch, or from about 7 g/inch to about 27 g/inch, or from about 9 g/inch to about 18 g/inch.

Figure 13:
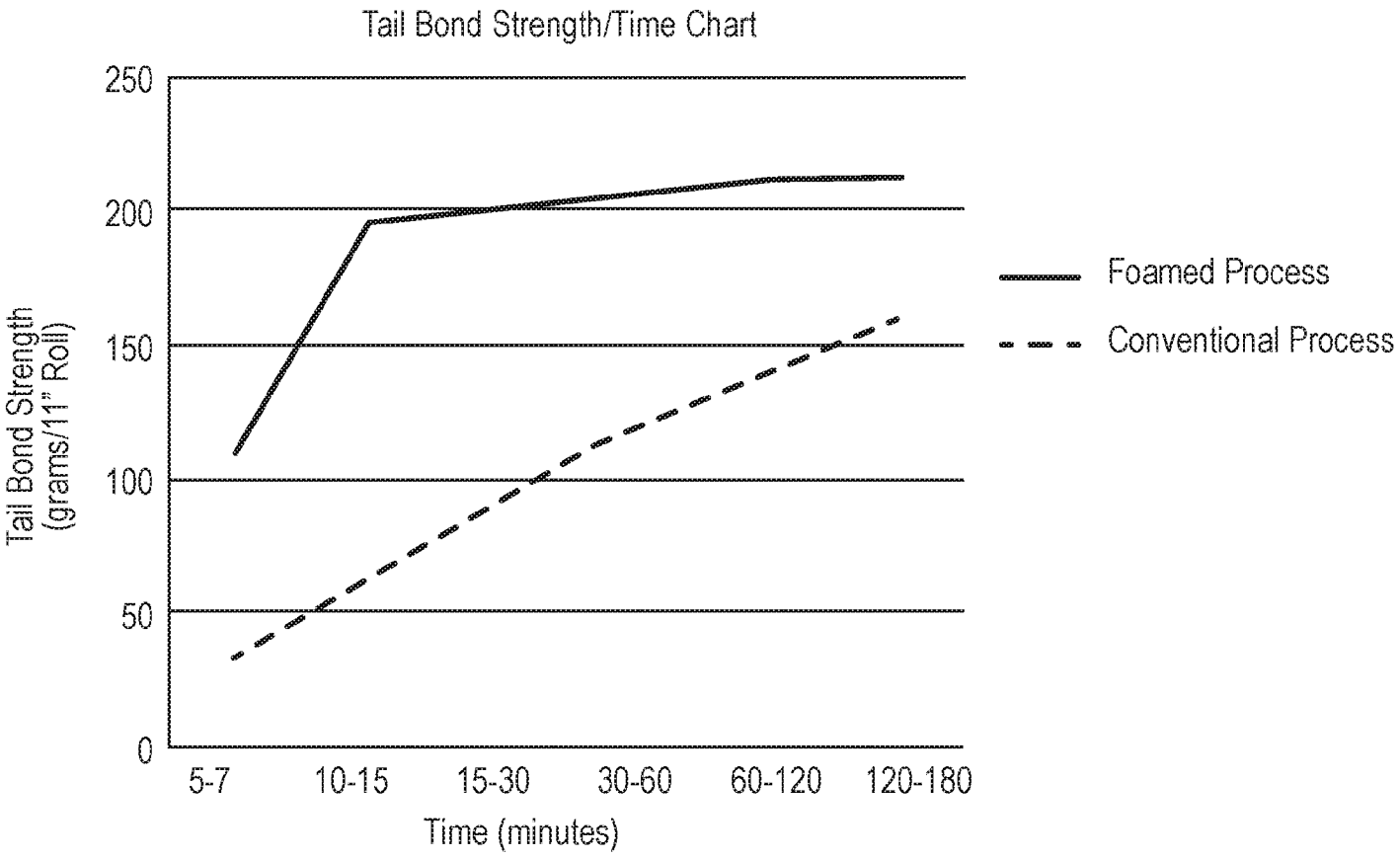
FIG. 13 is a graph displaying wet strength tail seal values in accordance with one embodiment of the present disclosure.

As shown in FIG. 13, consumer product units bonded with foaming adhesive in accordance with the present disclosure demonstrate higher peel strengths as determined by the Wet Strength Tail Seal Test when compared to consumer product units bonded with nonfoaming adhesive. In FIG. 13, the conventional line represents the performance of typical, non-foaming water-based adhesives over time regardless of the application mechanism.

Wet Strength Tail Seal Test Method

Tail seal wet strength of typical paper towel sample sealed in accordance with the apparatus and method described above can be evaluated using this method. Time should be chosen to correlate with approximate residence time in the accumulator. 5-7 minutes may be used but a higher number can be used if necessary. With non-foaming adhesive and approaches, longer times will typically increase the value of the resulting measurement as the adhesive has the opportunity to dry and bond. Typically, an average range of about 100 grams to about 200 grams per 11 inch roll of wet strength tail seal as measured by this method is expected from a typical paper towel sample sealed in accordance with the apparatus and method described supra.

A) Start timing from the glue application to the wound log.

B) Collect the roll once it is in consumer-sized finished roll format.

Figure 14:
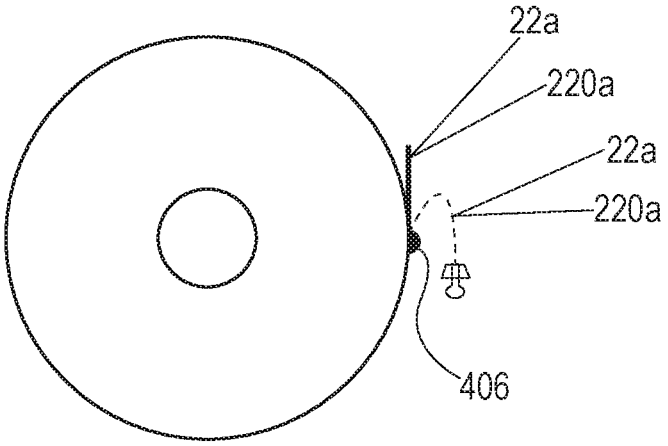
FIG. 14 is a cross-sectional view of a consumer-sized convolutely wound roll of web material according to one embodiment of the present disclosure.

C) Once 5-7 minutes has elapsed after glue application, begin testing. Hold roll in a horizontal position with the tail disposed at the 3 o'clock position, where the tail is pointed upwards as shown in FIG. 14.

D) While holding roll in position attach binder clips having known weights to the center of the tail. Successive clips are attached to alternating sides of the preceding clip. Alternatively, a single binder clip having a known weight can be used in combination with a set of known weights which can be added to the single clip either singly or in combination. (See FIG. 14 generally showing the movement of the tail once a clip is attached.)

E) Once the tail fully releases from the roll, stop and remove clips and/or weights.

F) Sum up the masses of the clips attached to the roll and total the weight of all of the clips or alternatively, the clip and the weights.

G) Enter the total weight in the summary sheet for comparison of condition wet strength.

The dimensions and/or values disclosed herein are not to be understood as being strictly limited to the exact numerical dimension and/or values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A convolutely wound material having a tail and a body, the tail being bonded to the body with a foamed adhesive.

2. The convolutely wound material of claim 1, wherein the tail and body are bonded at a line of adhesive.

3. The convolutely wound material of claim 1, where the convolutely wound material comprises a sanitary tissue product.

4. The convolutely wound material of claim 3, where the sanitary tissue product comprises embossing.

5. The convolutely wound material of claim 4, wherein the convolutely wound material further comprises a peak and a valley, wherein the maximum height distance between the peak and the valley is from about 365 μm to about 1750 μm.

6. The convolutely wound material of claim 4, wherein the convolutely wound material further comprises a peak and a valley, wherein the maximum height distance between the peak and the valley is from about 180 μm to about 780 μm.

7. The convolutely wound material of claim 1, wherein the convolutely wound material comprises a peel strength of about 2.5 g/inch of consumer-sized product unit to about 36.4 g/inch of consumer-sized product unit, at about 5 minutes to about 7 minutes after application of the foaming adhesive.

* * * * *